US009144824B2

(12) United States Patent
Cohen et al.

(10) Patent No.: US 9,144,824 B2
(45) Date of Patent: Sep. 29, 2015

(54) ATMOSPHERIC PRESSURE PLASMA-INDUCED GRAFT POLYMERIZATION

(75) Inventors: Yoram Cohen, Los Angeles, CA (US); Gregory Todd Lewis, Los Angeles, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 1444 days.

(21) Appl. No.: 12/513,941

(22) PCT Filed: Nov. 13, 2007

(86) PCT No.: PCT/US2007/023785
§ 371 (c)(1),
(2), (4) Date: May 7, 2009

(87) PCT Pub. No.: WO2008/060522
PCT Pub. Date: May 22, 2008

(65) Prior Publication Data

US 2010/0035074 A1 Feb. 11, 2010

Related U.S. Application Data

(60) Provisional application No. 60/857,874, filed on Nov. 10, 2006.

(51) Int. Cl.
*H05H 1/00* (2006.01)
*B05D 3/14* (2006.01)
(Continued)

(52) U.S. Cl.
CPC *B05D 3/144* (2013.01); *B05D 1/62* (2013.01); *B05D 7/04* (2013.01); *Y10T 428/31855* (2015.04)

(58) Field of Classification Search
CPC ..... B05D 3/144; B05D 7/04; B05D 1/62; Y10T 428/31855
USPC ..... 427/488
See application file for complete search history.

(56) References Cited

U.S. PATENT DOCUMENTS 4,781,733 A 11/1988 Babcock et al.
4,784,769 A 11/1988 Giordano et al.
(Continued)

FOREIGN PATENT DOCUMENTS

WO WO-01/34313 5/2001
WO WO2008/060522 5/2008

OTHER PUBLICATIONS

English abstract of JP 2001-159074.*
(Continued)

*Primary Examiner* — Robert S Walters, Jr.
(74) *Attorney, Agent, or Firm* — Foley & Lardner LLP; Cliff Z. Liu

(57) ABSTRACT

A method of modifying a polymeric, inorganic, or organic-functionalized substrate surface is provided. In one embodiment, an atmospheric pressure (AP) plasma stream is directed at a substrate surface, leading to the formation of surface-bound active sites that function as polymerization initiators. When contacted with a monomer or monomer solution, the active sites facilitate formation of a dense array of graft polymers covalently bound to the substrate surface. In another embodiment, an inorganic substrate is cleaned, conditioned in a humidity chamber, treated with an AP plasma, and contacted with a monomer or monomer solution to facilitate formation and growth of graft polymers on the substrate surface.

20 Claims, 25 Drawing Sheets

(51) Int. Cl.
*B05D 1/00* (2006.01)
*B05D 7/04* (2006.01)

(56) References Cited

U.S. PATENT DOCUMENTS

| | | | | |
|---|---|---|---|---|
| 5,028,332 | A | 7/1991 | Ohnishi | |
| 5,194,158 | A | 3/1993 | Matson | |
| 5,229,172 | A | 7/1993 | Cahalan et al. | |
| 5,248,427 | A | 9/1993 | Spiske et al. | |
| 5,364,662 | A | 11/1994 | Domenico et al. | |
| 5,366,639 | A | 11/1994 | Jones et al. | |
| 5,543,017 | A * | 8/1996 | Uchiyama et al. | 204/169 |
| 5,693,227 | A | 12/1997 | Costa | |
| 5,700,372 | A | 12/1997 | Takesawa et al. | |
| 6,107,425 | A | 8/2000 | Sinta et al. | |
| 6,169,127 | B1 | 1/2001 | Lohmann et al. | |
| 6,203,850 | B1 | 3/2001 | Nomura | |
| 6,335,401 | B1 | 1/2002 | Bertin et al. | |
| 6,440,309 | B1 | 8/2002 | Cohen | |
| 6,461,792 | B1 | 10/2002 | Kawamura et al. | |
| 6,465,056 | B1 | 10/2002 | Chabrecek et al. | |
| 6,465,505 | B1 | 10/2002 | Amin et al. | |
| 6,586,038 | B1 | 7/2003 | Chabrecek et al. | |
| 6,706,320 | B2 | 3/2004 | Filippou et al. | |
| 6,733,847 | B2 * | 5/2004 | Kunz et al. | 427/533 |
| 6,800,336 | B1 * | 10/2004 | Fornsel et al. | 427/562 |
| 7,591,948 | B2 | 9/2009 | Muller et al. | |
| 7,677,398 | B2 | 3/2010 | Belfer et al. | |
| 7,704,573 | B2 | 4/2010 | Itami et al. | |
| 7,717,273 | B2 | 5/2010 | Kozlov et al. | |
| 7,882,963 | B2 | 2/2011 | Mickols et al. | |
| 2002/0133072 | A1 | 9/2002 | Wang et al. | |
| 2003/0004083 | A1 | 1/2003 | France | |
| 2004/0014832 | A1 * | 1/2004 | Baudin et al. | 522/6 |
| 2004/0019143 | A1 | 1/2004 | Koloski et al. | |
| 2004/0171779 | A1 | 9/2004 | Matyjaszewski et al. | |
| 2005/0218536 | A1 | 10/2005 | Quinn et al. | |
| 2005/0256253 | A1 | 11/2005 | Parker et al. | |
| 2006/0019472 | A1 | 1/2006 | Pan et al. | |
| 2006/0051647 | A1 | 3/2006 | Tachibana et al. | |
| 2006/0076314 | A1 | 4/2006 | Sakurai | |
| 2006/0099439 | A1 | 5/2006 | Kochilla et al. | |
| 2006/0136048 | A1 | 6/2006 | Pacetti et al. | |
| 2006/0163766 | A1 | 7/2006 | Yasuhiro | |
| 2007/0209943 | A1 | 9/2007 | Bureau | |
| 2009/0308804 | A1 | 12/2009 | Cohen et al. | |
| 2009/0311540 | A1 | 12/2009 | Cohen et al. | |
| 2012/0031842 | A1 | 2/2012 | Freger et al. | |

OTHER PUBLICATIONS

Bataille et al. "Copolymerization of Styrene on to Cellulose Activated by Corona" Polymer International 34 (1994) 387-391.*
Carlmark "Atom Transfer Radical Polymerization from Multifunctional Substrates" (2002) Thesis (KTH, Superseded Departments, Polymer Technology).*
Devaux et al. "Controlled Polystyrene Brushes Grown on AFM Tip" Eur. Phys. J. E 10, 77-81 (2003).*
Ketelson et al. "Sterically Stabilized Silica Colloids: Radical Grafting of Poly(methyl methacrylate) and Hydrosilylative Grafting of Silicones to Functionalized Silica" Polymers for Advanced Technologies (1995) vol. 6, 335-344.*
Long et al. "Water-Vapor Plasma-Based Surface Activation for Trichlorosilane Modification of PMMA" Langmuir Apr. 2006, 22, 4104-4109.*
Ma et al. "Principal Factors Affecting Sequential Photoinduced Graft Polymerization" Polymer 42 (2001) 8333-8338.*
Schlemm et al. "Atmospheric Pressure Plasma Processing with Microstructure Electrodes and Microplanar Reactors" Surface and Coatings Technology (2001) 142-144, pp. 272-276.*
Cernakova et al. "Surface Modification of Polypropylene Non-Woven Fabrics by Atmospheric-Pressure Plasma Activation Followed by Acrylic Acid Grafting" Plasma Chemistry and Plasma Processing, vol. 25, No. 4 (Aug. 2005) 427-437.*
Ward "Atmospheric Pressure Plasmas for Surface Modification" (2001) Durham Theses, Durham University.*
Meyer et al. "Radical Grafting Polymerization of Vinylformamide with Functionalized Silica Particles" Macromol. Chem. Phys. 2003, 204, 725-732.*
Liu et al. "Influence of moisture regain of aramid fibers on effects of atmospheric pressure plasma treatment on improving adhesion with epoxy" Journal of Applied Polymer Science, vol. 102, Issue 1, pp. 242-247, Oct. 5, 2006.*
Schütze et al. "The atmospheric-pressure plasma jet: a review and comparison to other plasma sources." IEEE Transactions on Plasma Science 26:6 pp. 1685-1694 (Dec. 1998).
Gunther et al. "Selection of mine water treatment technologies for the Emalahleni (Witbank) Water Reclamation Project." WISA Biennial Conference & Exhibition, Durban, S.A. (2006).
Hilal, et al. "Methods employed for control of fouling in MF and UF membranes: a comprehensive review." Separation Sci. & Tech. 40:10, 1957 (2005).
Kim et al. "Plasma treatment of polypropylene and polysulfone supports for thin film composite reverse osmosis membrane." J. Membrane Science 286, 193-201 (2006).
Taniguchi et al. "Low fouling synthetic membranes by UV-assisted graft polymerization: monomer selection to mitigate fouling by natural organic matter." J. Membrane Science 222 59-70 (2003).
Belfer et al. "Modification of NF membrane properties by in situ redox initiated graft polymerization with hydrophilic monomers." J. Membrane Science 239 55-64 92004).
Belfer et al. "Surface modification of commercial composite polyamide reverse osmosis membranes." J. Membrane Science 139 175-181 (1998).
Belfer et al. "Surface modification of commercial polyamide reverse osmosis membranes by radical grafting: an ATR-FTIR study." Acta Polym. 49 574-582 (1998).
Gilron et al. "Effects of surface modification on antifouling and performance properties of reverse osmosis membranes." Desalination 140 167-179 (2001).
Mukherjee et al. "Flux enhancement of reverse osmosis membranes by chemical surface modification." J. Membrane Science 97 231-249 (1994).
Hinman et al. "Composite reverse osmosis membranes prepared by plasma polymerization of allylamine. Evaluation of membrane performance for the treatment of washwater and its components." J. Applied Polymer Science 23, 3651-3656 (1979).
Brink et al., "The anti-fouling action of polymers preadsorbed onbelf ultrafiltration and microfiltration membranes." J. Membrane Science 76, 281-291 (1993).
Chen et al., "Preparation of sulfonated polysulfone/polysulfone and aminated polysulfone/polysulfone blend membranes." J. App. Polymer Science:61,1205-1209 (1996).
Chu et al., "Preparation of thermo-responsive core-shell microcapsules with a porous membrane and poly(N-isopropylacrylamide) gates." J. Membrane Science 192, 27-39 (2001).
Chu et al., "Thermoresponsive transport through porous membranes with grafted PNIPAM gates." AIcHE Journal 49:4 (2003).
Chung et al., "Atmospheric RF Plasma Effects on the Film Adhesion Property." Thin Solid Film 447-448, 354-358 (2004).
Dong et al., "Plasma-mediated grafting of poly(ethylene glycol) on polyamide and polyester surfaces and evaluation of antifouling ability of modified substrates." Langmuir 23, 7306-7313 (2007).
Hester et al., "Preparation of protein-resistance surfaces on poly(vinylidene fluoride) membranes via surface segregation." Macromolecules 32: 1643-1650 (1999).
Isaacs et al. (Ed.), "Molar Gibbs Function." The Oxford Dictionary for Scientific Writers and Editors Oxford Univ. Press, pp. 228 (1991).
Kai et al., "Preparation of organic/inorganic composite membranes by plasma-graft filling polymerization technique for organic-liquid separation." Ind. & Engr. Chem. Res. 39 ,3284-3290 (2000).
Lee et al., "Preparation of pH/temperature responsive polymer membrane by plasma polymerization and its riboflavin permeation." Polymer 38:5, 1227-1232 (1997).

(56) References Cited

OTHER PUBLICATIONS

Lee et al., "Preparation of surface-modified stimuli-responsive polymeric membranes by plasma and ultraviolet grafting methods and their riboflavin permeation." Polymer 36:1, 81-85 (1995).
Shenton et al., "Surface modification of polymer surfaces; atmospheric plasma versus vacuum plasma treatments." J. Physics D, Applied Physics 34, 2761 (2001).
Ulbricht et al., "Surface modification of ultrafiltration membranes by low temperature plasma ii. graft polymerization onto polyacrylonitrile and polysulfone." J. Membrane Science 111,19 3-215 (1996).
Wang et al., "Electroless plating of copper on fluorinated polyimide films modified by surface graft copolymerization with 1-vinylimidazole and 4-vinylpyridine." Polymer Engr. & Science, 44, 362-375 (2004).
Wavhal et al., "Hydrophilic modification of polyethersulfone membranes by low-temperature plasma-induced graft polymerization." J. Membrane Science 209, 255-269 (2002).
U.S. Appl. No. 12/482,272, Office Action dated Mar. 8, 2011.
U.S. Appl. No. 12/482,272, Office Action dated Aug. 31, 2011.
U.S. Appl. No. 12/482,264, Office Action dated Jan. 5, 2011.
U.S. Appl. No. 12/482,264, Office Action dated Jun. 28, 2011.
U.S. Appl. No. 12/482,264, Office Action dated Mar. 23, 2012.
EP Patent Appln. No. EP07861962. Search Report & Written Opinion dated Dec. 6, 2010.
Chilean Patent Appln. No. 1401.2008. Translation of 1st Office Action dated Dec. 6, 2012.

* cited by examiner

B)

ATMOSPHERIC PRESSURE PLASMA-INDUCED GRAFT POLYMERIZATION

CROSS REFERENCE TO RELATED APPLICATION

This application is a National Stage Entry of PCT/US2007/023785 filed Nov. 13, 2007, which claims the benefit of U.S. Provisional Application No. 60/857,874 filed Nov. 10, 2006, the disclosure of which is incorporated by reference in its entirety.

FIELD OF INVENTION

The invention generally relates to surface modification techniques, and more particularly to low temperature, atmospheric pressure plasma surface treatments and graft polymerization processes.

BACKGROUND OF THE INVENTION

Surface nanostructuring by grafting functional polymers to a substrate surface has been used to enhance chemical functionality and to alter the surface topology of native inorganic and organic materials. For example, graft-polymerized ethylenically unsaturated monomers offers unique properties in applications such as micropatterning in electronics fabrication, adhesion in carbon fibers and rubber dispersions, and as selective layers in fuel cells and separation membranes. Organic and inorganic surfaces modified with grafted polymers have demonstrated anti-fouling characteristics in separation membranes, high chemical selectivity in chemical sensors, and surface lubricating properties. In such applications, the grafted polymer phase, composed of nanoscale, single-molecule chains covalently and terminally bound to a substrate or surrogate surface, serves to impart unique material properties to the substrate while maintaining the chemical and physical integrity of the native surface. Moreover, the grafted chains remain attached to the surface even when exposed to a solvent in which the polymer is completely miscible.

A tethered polymer phase can be formed either by polymer grafting ("grafting to") or graft polymerization ("grafting from"). Surface chain coverage and spatial uniformity achieved by polymer grafting may be limited by steric hindrance. In contrast, graft polymerization, which is the focus of the present invention, proceeds by sequential monomer addition, thereby allowing for the formation of a denser surface coverage.

Structuring surfaces with grafted vinyl monomers and other ethylenically unsaturated monomers is commonly achieved by free radical graft polymerization (FRGP), where the polymer chain size, chain length uniformity, and surface density are dictated by the initial monomer concentration, reaction temperature and density of the surface immobilized initiators or initiators in solution. However, broad molecular weight chain size distributions resulting from uncontrolled macroradical reactions in solution and limitations in surface density due to the restriction of pre-grafted surface initiation sites make this approach unattractive for nanoscale-engineered polymer surface architectures.

Free radical polymerization relies on initiator species to initiate either solution polymerization, in which polymers grown in solution may bind to reactive surface sites by polymer grafting, or surface polymerization, in which monomers undergo direct surface grafting from immobilized surface initiators (e.g., surface-grafted reactive groups) or surface monomers (e.g., ethylenically unsaturated monomers) by graft polymerization (e.g., surface grafted reactive groups). However, the occurrence of competitive polymer chain grafting, chain transfer reactions, and surface chain growth by propagation result in a polydisperse grafted polymer chain size in contrast to the more uniform surface chain size that is achieved by grafting of preformed polymer chains of a uniform size. Further, for inorganic substrates, the density of grafting sites for graft polymerization is limited by the availability of surface hydroxyl groups on the oxide surface, which serve as anchoring sites for surrogate surface initiators and macroinitiators. For example, the surface concentration of hydroxyl groups on fully hydrolyzed silica and zirconia are 7.6 μmoles/$m^2$) (4.6 molecules/$nm^2$) and 5.6-5.9 μmoles/$m^2$ (3.4-3.6 molecules/$nm^2$), respectively.

In recent years, the demand for sophisticated, advanced materials for nanoscale devices has led to a growing interest in controlled radical polymerization (CRP), whereby grafted polymer domains may be precisely structured by controlling polymer chain growth and grafted chain polydispersity. CRP utilizes a control agent that reversibly binds to the surface-bound macroradical chain, establishing a thermodynamic equilibrium that favors the capped polymer in the dormant phase. The presence of the control agent limits the number of "live" chains in solution, thus enabling control over the rate of surface polymerization while reducing chain termination. Controlled polystyrene graft polymerization, with number-average molecular weights ($M_n$) and polydispersity indices (PDI), has been reported for the following CRP methods: atom transfer radical graft polymerization (ATRGP) ($M_n$=10,400-18,000 g/mol and PDI=1.05-1.23), reversible addition-fragmentation chain transfer (RAFT) graft polymerization ($M_n$=12,800-20,000 g/mol, PDI=1.10-1.40), and nitroxide-mediated graft polymerization (NMGP) ($M_n$=20,000-32,000 g/mol, PDI=1.20-1.30) for grafting of polystyrene onto silica and polymeric materials (e.g., polyglycidyl methacrylate (PGMA), polythiophene, polypropylene, and polyacrylate).

However, ATRGP and RAFT pose unique constraints. For example, ATRP requires a precise initiator-to-catalyst-to-monomer ratio, optimal temperature/solvent conditions, and surface-bound organic halide initiators, which potentially limits the surface graft density. RAFT graft polymerization requires thio-ester surface initiators for grafting. On the other hand, NMGP relies on conventional peroxide initiators and/or thermal initiation to form polymer chain radicals that may then, for example, reversibly bind to an alkoxyamine for controlled polymerization.

Plasma surface treatment has been proposed as an approach to alter surface chemistry and potentially supplant previous solution phase initiator strategies with high density surface activation. Plasma treatment alone, however, has been shown to be an insufficient surface modification tool; polymeric, plasma-treated surfaces do not retain their modified chemical properties over time and with air exposure. Vapor phase plasma polymerization, in which monomer fed through plasma is initiated in the gas phase and then polymerized on a substrate surface, has also been investigated as a surface modification method. However, surface-adsorbed radical monomer species, which are designed to polymerize with condensing monomer radicals from the vapor phase, may in fact be further modified by continuous plasma bombardment, leading to highly cross-linked, chemically and physically heterogeneous polymer films that are non-covalently adsorbed to the surface. Also, the local concentration of monomer species in the plasma afterglow is highly dependent on the radial dimensions of the plasma source, and the resulting spatial variations in monomer deposition rate may lead to a non-uniform film structure and morphology.

Plasma-induced graft polymerization (PIGP) is an alternative surface modification approach in which plasma is used to activate the surface, and ethylenically unsaturated monomers in the liquid phase are sequentially grafted to the initiation sites via a free radical grafting mechanism. This approach allows one to engineer a grafted polymer phase characterized by a high surface density of polymer chains that are initiated and polymerized directly from the substrate surface, thus minimizing polydisperse chain growth, and improving stability under chemical, thermal and shear stresses. Given the complex surface chemistry and limited lifetime of reactive plasma initiated surface species, the exact chemical nature of these plasma-generated organic moieties is yet to be established.

To date, PIGP has focused primarily on low pressure (i.e., below atmospheric) plasma initiation and surface grafting on polymeric materials. An example is low pressure polystyrene surface grafting used for surface structuring of Nafion fuel cells and separation membranes. Limited studies of low pressure plasma surface treatment of inorganic oxides, such as titanium dioxide, have also been reported. However, restrictions associated with low pressure plasma processing (e.g., the need for a vacuum chamber) are a hindrance for potential scale-up opportunities in industrial applications.

A notable limitation for achieving PIGP on inorganic substrates, unlike polymeric materials, has been the requirement of a sufficiently dense layer of surface activation sites, created through silylation of reactive monomers or macroinitiator grafting, that may form surface radicals for polymer initiation upon plasma treatment. Surface preparation required for such techniques combined with the reliance on surface hydroxyl chemistry limits the large-scale adaptation of such methods and the level of chain density that can be achieved. Direct plasma initiation and grafting without the use of surrogate surfaces has been demonstrated qualitatively on titanium oxide particles and silicone rubber materials, with characteristic surface radical formation noted as a function of treatment time and RF power, similar to organic materials. Yet, a recent study has demonstrated that, under low pressure plasma surface treatment of Shirasu porous glass, a direct correlation between silanol density and grafted polymer density is observed. This suggests that the number density of surface radicals that may be achieved in low pressure plasma surface activation of inorganic oxide substrates may be limited by the native oxide surface chemistry.

These findings, combined with the added requirement of ultra high vacuum chambers necessary for low pressure plasma processing, indicate that prior art approaches are insufficient for achieving high-density surface activation and graft polymerization, and especially inadequate for large surface area modification of organic and inorganic substrates.

SUMMARY OF THE INVENTION

The present invention provides a novel method of modifying inorganic and organic substrates by growing end-grafted polymers from a surface of the substrate in a controlled manner. In one aspect, the invention comprises treating a substrate surface with (a) an atmospheric pressure (AP) plasma and (b) an ethylenically unsaturated monomer or monomer solution. AP plasma treatment forms "active sites" on the surface that function as surface-anchored polymerization initiators. When contacted with a monomer, the active sites cause the monomer to polymerize, resulting in a plurality of end-grafted polymer chains covalently bound to the substrate. The active sites can be peroxides, oxides, hydroxyls, amines, hydrides, radicals, epoxides, or other chemical moieties, i.e., functional groups capable of initiating polymerization. Polymerization can proceed by classical free radical graft polymerization (FRGP) or controlled radical polymerization (CRP), such as ATRGP, RAFT, NMGP, etc. Surface activation is controlled by adjusting the plasma operating parameters—e.g., plasma source, plasma precursor and carrier gas, gas flow rate, gas partial pressure, radio frequency power, and applied voltage, as well as surface treatment time and preparation of the substrate surface—to maximize the formation of surface radicals or peroxides.

The invention is exemplified by a number of embodiments. For example, for inorganic substrates, one embodiment of the invention comprises the steps of cleaning a surface of a substrate to remove contaminants and a native oxide layer, if present; forming a layer of water on the surface of the substrate by, e.g., placing the substrate in a humidity chamber; generating initiation sites on the substrate surface by treating the substrate with an atmospheric pressure (AP) plasma; and growing polymers from the surface of the substrate by exposing the polymerization initiation sites to a monomer or monomer solution. In another embodiment, the surface of an organic polymeric substrate is modified by generating polymer initiation sites on the substrate surface by treating the substrate with an atmospheric pressure (AP) plasma; and growing polymers from the surface of the substrate by exposing the polymerization initiation sites to an ethylenically unsaturated monomer or monomer solution. In still another embodiment, the method is used to modify the surface of an organo-functionalized inorganic substrate such as a vinyl-functionalized silica or silicon.

Atmospheric pressure plasma-induced graft polymerization (APPIG polymerization) has a number of advantages over non-plasma, classical free radical graft polymerization and controlled "living" graft polymerization, vapor-phase plasma polymerization, and low-pressure plasma-induced polymerization. Among other things, APPIG polymerization does not rely on chemical initiators in solution and does not require expensive—and potentially scale-up limiting—ultra-high vacuum chambers and associated equipment for plasma processing. Initiation of monomer polymerization occurs on the substrate surface, minimizing foliation of high molecular weight homopolymers and polymer grafting from the bulk. Consequently, APPIG polymerization-modified surfaces exhibit a higher degree of polymer chain length uniformity than classical methods. The invention also allows a highly dense, substantially uniform layer of single-molecule grafted polymers to be grown sequentially from an inorganic or organic surfaces. Tests on inorganic substrates, for example, demonstrate that AP plasma treatment directly modifies the inorganic surface lattice, resulting in a high density of initiation sites that enable graft polymerization with polymer-polymer separations that can be 10 nm or less, without the need for extensive chemical surface treatment. The invention therefore opens the door to improved materials in a number of fields, such as microelectronics, biomedics, membrane separation, flocculant and coagulant technology, chemical sensors, and general surface coatings.

BRIEF DESCRIPTION OF THE DRAWINGS

Various other aspects, embodiments, and advantages of the invention will become apparent upon reading the Detailed Description and by referring to the appended drawings, wherein.

DETAILED DESCRIPTION

According to the invention, a novel method of modifying the topology and physico-chemical properties of a substrate surface using APPIG polymerization is provided. Generally, the method comprises treating a substrate surface with an atmospheric pressure (AP) plasma and an ethylenically unsaturated monomer or monomer solution. In a preferred approach, an atmospheric pressure plasma stream is directed at the surface, using, for example, an AP plasma jet. AP plasma treatment causes surface-bound active sites, i.e., chemical functional groups such as peroxides, radicals, etc., to form on the substrate. When contacted with an unsaturated monomer or monomer solution, the active sites (also referred to as polymerization initiators) facilitate the formation and controlled growth of graft polymers from the surface of the substrate. The method is suitable for surface modification of inorganic, organic, and mixed inorganic/organic substrates, such as organo-functionalized substrates, e.g., alkoxy silylated silicon.

Nonlimiting examples of suitable inorganic substrates include elemental materials, such as silicon, aluminum, hafnium, zirconium, titanium, iron, and gold; inorganic oxides, such as silica, alumina, hafnia, zirconia, titania; and other metallic, metalloid, or ceramic materials capable of supporting the formation of surface oxides, hydroxides, peroxides, or other functional groups that can initiate polymerization when exposed to a monomer or monomer solution. In theory, any organic or inorganic substrate capable of supporting the formation of polymerization initiation sites can be modified using the present invention. Nonlimiting examples include polymeric materials, dendritic materials, thiols, Langmuir-Blodgett films, and silylated layers. Specific, nonlimiting examples of organic polymer substrates include polystyrene, polyamides, polysulfone, poly(vinyl alcohol), and organo-silicon polymers.

Figure 1:
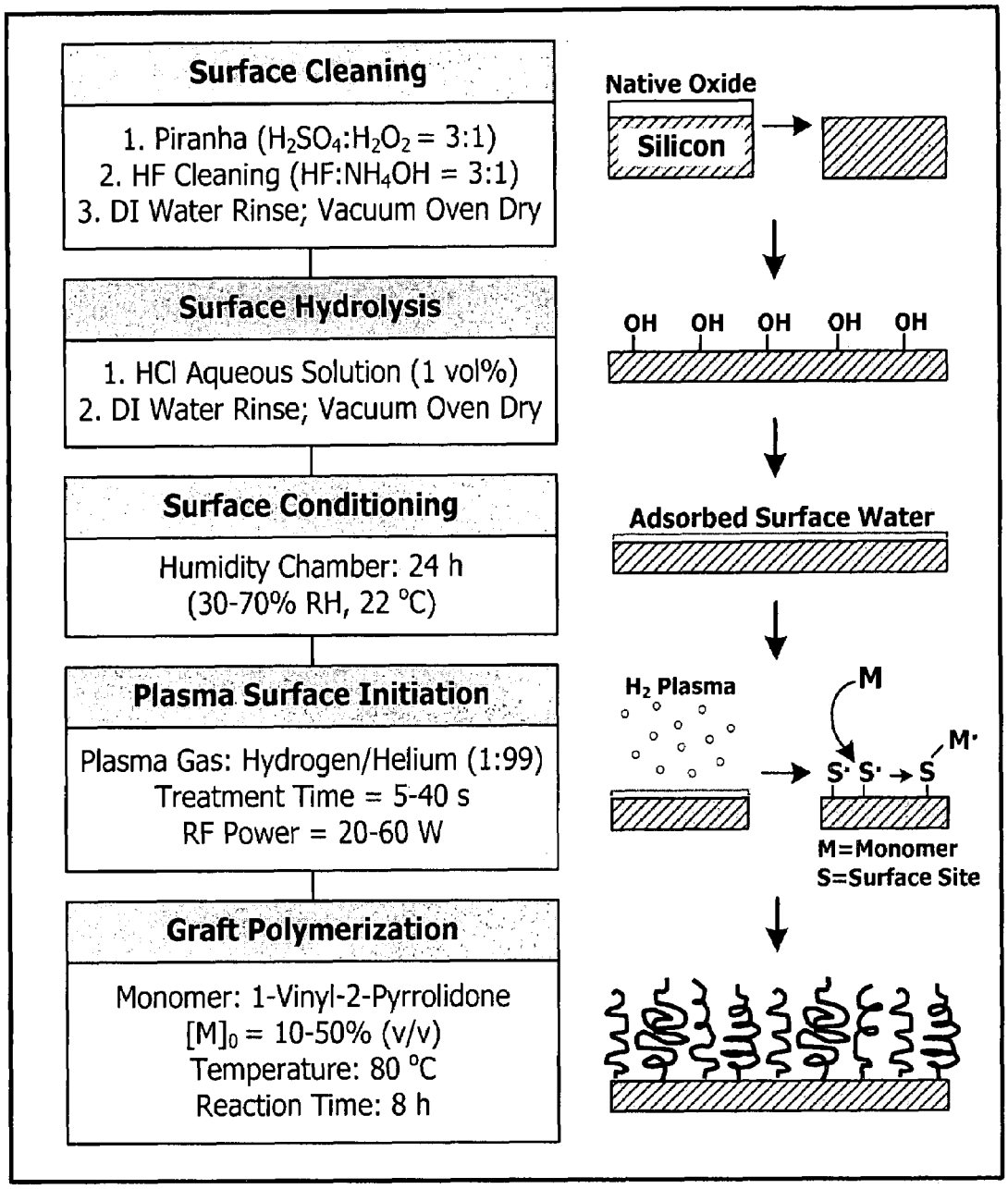
FIG. 1 is a schematic illustration of a method of modifying a silicon substrate surface according to one embodiment of the invention.

FIG. 1 illustrates a multi-step process of APPIG polymerization according to one embodiment of the invention in which a silicon wafer is modified by graft polymerizing 1-vinyl-2-pyrrolidone monomers from a surface of the wafer. First, the substrate is prepared by a multi-step cleaning and conditioning process to remove surface contaminants and the native oxide layer on the substrate. Thus, the substrate is cleaned in a "piranha" solution (e.g., 3:1 or 7:3 sulfuric acid: hydrogen peroxide), and then rinsed in deionized water to remove absorbed organics and acids. Native oxide films present on inorganic silicon are heterogeneous in nature, can easily be etched, and therefore are removed to ensure effective graft polymerization. This is accomplished using, e.g., hydrofluoric acid followed by immersion in a water bath to remove residual acid and the native oxide layer, and then drying the substrate in a vacuum oven (heated, for example, to a temperature of 60-100° C.). Once dried, the substrate is "conditioned" by placing the substrate in a humidity chamber for several hours, preferably as long as 24 hours, to ensure that a controlled layer of adsorbed water is present prior to AP plasma treatment. Alternatively, the surface can be conditioned in ambient air if the appropriate relative humidity is achieved, although, in general, a humidity chamber provides better control.

For an inorganic substrate such as silicon, the highest density of surface active sites is obtained when the amount of surface water adsorbed on the substrate surface is carefully controlled prior to AP plasma treatment. Adsorbed water appears to facilitate the formation of peroxides or other surface active groups during plasma treatment, which then act as polymerization initiators when the substrate surface is exposed to a monomer. For a silicon wafer, optimal results are obtained when the surface water coverage is approximately a single monolayer, substantially homogenously across the substrate surface. Surface water film thickness significantly less than or greater than optimal coverage will result in suboptimal formation of AP plasma-induced activation sites. Surface water coverage can be achieved by placing the inorganic substrate in a controlled humidity environment, i.e., a humidity chamber with temperature and relative humidity (RH) control. Typical RH values are 20-70%, with optimum results achieved at ~50% RH at 22° C. Alternatively, water can be included with the plasma precursor and/or carrier gas(es) to promote surface peroxide formation.

Surface activation of an inorganic substrate using an AP plasma can be achieved even in the absence of an adsorbed water layer, though active site density will be significantly lower than when a layer of adsorbed water is present.

Figure 2:
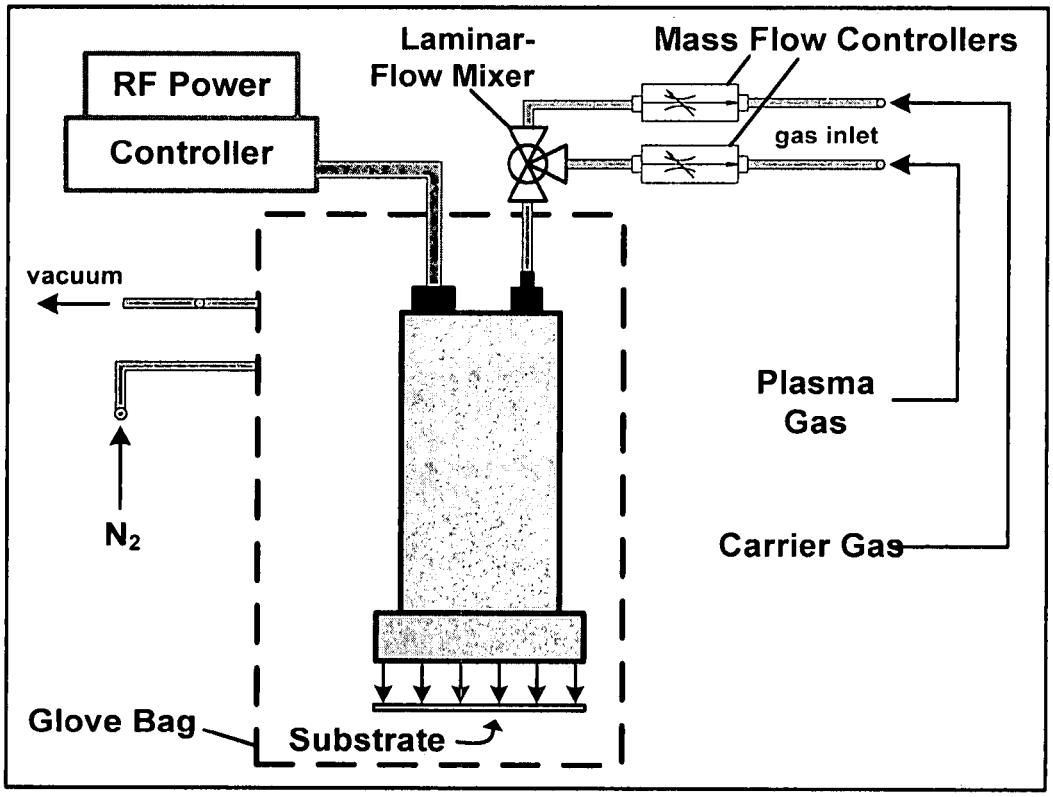
FIG. 2 is a schematic illustration of an AP plasma generator used in the method shown in FIG. 1.

After cleaning and conditioning the silicon wafer, the wafer is exposed to an AP plasma either in an enclosed container under an inert gas (e.g., nitrogen, argon, etc.) or in an open environment of ambient air. FIG. 2 schematically illustrates one nonlimiting example of an AP plasma apparatus suitable for use in the practice of the invention. As shown, the apparatus can include or be housed in a glove bag or other chamber in which a substrate can be placed, and includes a plasma source, a radio frequency (RF) power generator, a controller (e.g., a microprocessor) coupled to the RF power generator and a matching network, a laminar flow mixer and mass flow controllers for introducing a plasma precursor gas/carrier gas into the system, an inlet for nitrogen gas, and an outlet line that may be coupled to a gas pump. The plasma source produces a plasma stream that emanates from an outlet having a preferred geometry (e.g., rectangular or circular) and impinges upon the substrate surface. The outlet line and nitrogen inlet permit the chamber to be purged and flushed with nitrogen prior to use. However, the chamber is maintained under atmospheric pressure during the surface activation and graft polymerization process.

In another embodiment (not shown), the glove bag or other chamber is omitted, and an AP plasma is simply generated and directed at a substrate surface in an open environment. In that case, the nitrogen inlet, vacuum line, and vacuum pump are not needed.

Additional, nonlimiting details about AP plasma generators are found in Schutze, A.; Jeong, J. Y.; Babayan, S. E.; Park, J. Selwyn, G. S.; Hicks, R. F. *IEEE Trans. Plasma Sci.* 1998, 26, (6), 1685-1694, which is incorporated by reference herein.

Plasma gas, RF power, electrode voltage, treatment time, gas flow rate, gas partial pressure, total pressure, and gas temperature. Plasma treatment can be achieved by using one or more plasma precursor gases; nonlimiting examples include hydrogen, oxygen, nitrogen, air, carbon dioxide, water, fluorine, helium, argon, neon, ammonia, and methane, optionally in combination with a carrier gas, for example, helium.

Hydrogen plasma, which is commonly used in nanoelectronics for surface cleaning, is composed of hydrogen atoms formed by electron impact dissociation, which may either recombine further downstream of the discharge region or can be used for surface treatment. Hydrogen plasma has an intrinsically low silicon etch rate, and can be operated at low processing temperatures, unlike oxygen plasma which requires a high power density for processing. For example, in some embodiments, the hydrogen plasma gas temperature did not exceed 100° C. over an exposure period of 60 s at RF power of 60 W.

Activating the substrate surface with an AP plasma provides a number of advantages over surface activation using a low pressure plasma, particularly where the AP plasma is generated using a plasma jet. The advantages pertain both to the configuration and operating parameters of the AP plasma generator and to the properties of the generated plasma gas, and are especially evident when one compares plasma jet AP plasma activation to dielectric barrier discharge (DBD) plasma activation.

A DBD plasma source is typically designed in a parallel plate configuration, in which two parallel plates are separated from one another by at most a few millimeters. Plasma particles exit the top electrode in small, independent microarcs and travel to the bottom electrode. The microarcs are about 100 μm in diameter and may be separated by as much as 2 cm. Because of the configuration and spacing of the streamers, this method results in a non-uniform plasma discharge. In addition, the breakdown voltage, which is the minimal voltage needed to sustain plasma generation, is 5-25 kV. In terms of scale-up potential, the parallel plates are fixed and the electrode spacing cannot be increased. Also, the DBD source cannot be moved to scan the surface during plasma surface treatment.

In contrast, an AP plasma jet is a source consisting of two concentric electrodes from which plasma is discharged. The source can be easily positioned over a substrate for surface treatment. The plasma discharge is spatially and temporally uniform and may be operated at various flow rates. The breakdown voltage for the plasma jet is in the range of 0.05-0.2 kV, significantly lower than for DBD sources. Also, the plasma jet operates over a wider and more stable voltage range than for the DBD source. The plasma jet maintains low processing gas temperatures for certain plasmas, which is ideal for graft polymerization onto thermally sensitive materials. The plasma jet offers many advantages for scale-up potential, as a fixed source that can be positioned at different lateral spacing arrangements or as a movable source.

The properties of the generated plasma gas are also different for the two techniques. The DBD source operates over an electron temperature range of 1-10 eV, which results in a plasma gas temperature that approaches 200° C. The electrons and ions exist for only a short period of time (less than about 100 ns), which limits the effectiveness of surface treatment. The density of plasma species, for example oxygen in helium, is about $10^{12}$ particles/cm$^3$. The density of charged species, on the other hand, is approximately $10^{12}$-$10^{15}$ particles/cm$^3$.

In contrast, the hydrogen plasma jet operates over a lower electron temperature range of 1-2 eV, which corresponds to a gas temperature of under 100° C. (slightly higher for oxygen plasma). For oxygen plasma, the activated oxygen atoms exist in the excited state for up to 80 mm from the gas exit region. The density of plasma species, for example oxygen in helium, is about $10^{16}$ particles/cm$^3$, four orders of magnitude higher than for DBD sources. The density of charged species, on the other hand, is approximately $10^{11}$-$10^{12}$ particles/cm$^3$. This significantly higher plasma species density enables substrate surfaces to be modified to a much greater extent, allowing very dense active site formation. Subsequent contact with a polymerizable monomer results in the formation of a very dense array of grafted polymer chains bound to the surface, with average polymer separations at least as small as 10 nm.

Exposing the conditioned substrate to an atmospheric pressure plasma results in the formation of a dense, substantially homogeneous array of surface-bound active sites ("polymer initiation sites") on the substrate surface, i.e., functional groups capable of initiating polymerization upon exposure to a monomer. Nonlimiting examples of such groups include peroxides, oxides, hydroxyls, amines, hydrides, epoxides, and radicals. For dilute hydrogen in helium (1:99 $H_2$:He), a dense array of active surface sites for graft polymerization can be achieved by varying RF power from about 20 to 60 W, with plasma treatment times ranging from about 5 to 120 seconds. For a silicon substrate and a hydrogen-helium plasma, the highest surface coverage of active sites were obtained at an RF power of about 40 W and a plasma treatment time of about 10 s (the same was true for AP plasma-treatment of a polymeric substrate). Optimal conditions (highest density of surface active sites for polymerization initiation) may vary, however, depending on the nature of the substrate surface, the plasma gas, and the desired level of surface activation. The amount of adsorbed surface water, as well as the plasma power, treatment time, and other processing parameters are variable and can be controlled as necessary to maximize active site—and, ultimately, graft polymer—density.

Surface functionality can also be adjusted by exposing the plasma-treated surface to a desired gas or liquid immediately following plasma treatment. For example, exposing a plasma-treated surface to air, pure oxygen, or water can lead to the formation of peroxide groups. In one experiment, extending the period of exposure to water or oxygen for up to 2 minutes did not significantly reduce the concentration of surface active groups. Surface activation can be achieved also without immersing the plasma-modified surface in a gas or liquid. In addition, water can be included with the plasma precursor and/or carrier gas(es) to promote formation of surface peroxides.

After activating the substrate surface with AP plasma for a desired time, an ethylenically unsaturated monomer or monomer solution is introduced and allowed to contact the polymer initiation sites on the surface of the substrate, thereby facilitating polymer chain growth directly from the surface of the substrate. The polymer chains are covalently bound to the substrate through the active site moieties or their residues.

Any ethylenically unsaturated monomer that can be polymerized in a liquid phase reaction mixture via classical free radical polymerization or controlled radical polymerization can be used. Nonlimiting examples include vinyl and divinyl monomers, with specific examples being methacrylic acid, acrylic acid, other acid vinyl monomers, acrylic and methacrylic esters, such as methyl methacrylate and butyl acrylate, polar vinyl monomers such as vinyl pyrrolidone and vinyl pyridine, and non-polar vinyl monomers, such as styrene and vinyl acetate. 1-Vinyl-2-pyrrolidone (VP) is of interest because poly(vinyl pyrrolidone) has excellent biocompatible properties, has been proposed as a surface modifier to reduce membrane fouling, and is miscible in both aqueous and organic media. Combinations of two or more monomers can be used to form graft copolymers.

The ethylenically unsaturated monomers can be provided as pure monomer in the liquid phase or as a monomer solution, and is allowed to contact the plasma-treated surface for a time and at a temperature sufficient to cause graft polymer chains to grow from the surface of the substrate.

Notably, the choice of solvent can play an important role in facilitating graft polymerization from the surface of the substrate, as it allows for increased miscibility (i.e., solubility) between the monomer(s) and the surface of the substrate, and, therefore, improved monomer wetting power. For example, for hydrophilic (i.e., polar) monomers, water and/or another polar solvent can be used. Nonlimiting examples include N-methyl-2-pyrrolidone, tetrahydrofuran, and alcohols. For hydrophobic (i.e., non-polar) monomers, the solvent will typically be non-polar, for example, chlorobenzene or toluene. Mixtures of solvents can be used. As a general rule of thumb, the highest surface densities of grafted polymer chains are obtained with monomer-solvent pairs having high surface wetting power with plasma surface initiation achieved at the optimal conditions.

Polymer growth from the plasma-activated substrate surface may be directed either by classical free-radical graft polymerization or by controlled "living" graft polymerization. In the former, polymerization is controlled by initial monomer concentration, reaction temperature, reaction time, and optionally the use of chain transfer agents, and results in surfaces with highly polydisperse polymer chain length (typically pI≥2). With controlled "living" graft polymerization, surfaces having a high density of grafted polymer chains with a uniform chain size distribution (pI<1.5) can be achieved. In theory, polymerization can proceed to completion, i.e., until the monomer is exhausted.

Nonlimiting examples of suitable controlled "living" polymerization approaches include those that require a free-radical molecule (i.e., a free radical control agent) in solution to control polymerization, such as Reversible Addition Fragmentation Transfer (RAFT) Polymerization and Nitroxide-Mediated Graft Polymerization (NMGP). For NMGP, a stoichiometric amount of free-radical molecules is added to the reaction mixture with a plasma-activated surface and controls growth of the free-radical polymer propagating from the surface. Nitroxide-mediated polymerization using a 2,2,6,6-tetramethyl-1-piperidinyloxy (TEMPO) control agent is described below in Example 5.

After graft polymerization, the modified surface can be washed in an appropriate solvent to remove physically adsorbed homopolymer (or copolymer, if two or more monomers were used in the polymerization). Thus, water or another polar solvent is used to remove adsorbed polar homopolymers (e.g., poly(vinyl pyrrolidone), and a non-polar solvent, for example, toluene, is used to remove adsorbed non-polar homopolymers (e.g., polystyrene).

In another embodiment of the invention, APPIG polymerization is used to modify the surface of an inorganic substrate other than silicon, for example, any of the previously listed metals, metalloids, metal oxides, and other metallic or ceramic materials capable of supporting the formation of surface active sites. As with the silicon wafer, the method comprises the steps of surface cleaning and conditioning, formation of active sites on the surface using an AP plasma, and contacting the active sites with a monomer or monomer solution to facilitate the formation and growth of graft polymer chains from the substrate surface.

In another embodiment of the invention, an organo-functionalized inorganic substrate is modified by APPIG polymerization. For example, silica and similar materials can be vinyl-functionalized (i.e., silylated with a vinyl group-containing silyl molecule) by (a) hydrolysis and (b) reaction with a vinyl-substituted molecule, yielding vinyl functionalized surfaces that can be activated by AP plasma treatment and then allowed to contact a monomer or monomer solution, which causes end-grafted polymer chains to grow from the surface of the substrate. The use of vinyl lower alkoxy silanes to activate inorganic oxide surfaces is described in U.S. Pat. No. 6,440,309 (Cohen), the entire contents of which are incorporated by reference herein. Briefly, the method entails the formation of surface hydroxyl groups (using, e.g., an aqueous acid solution), followed by reaction with a vinyl activation (e.g., a vinyl-silane). Representative vinyl activators include vinyl alkoxy silanes, having the following formula:

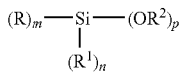

wherein R is an organic group; $R^1$ is an organic group containing at least one vinyl functional group; $R^2$ is a lower alkyl (i.e., C1-C3 alkyl); m is 0, −1 or 2; n is 1 to 3; p is 1 to 3; and the sum of m, n, and p is 4. Specific, nonlimiting examples of vinyl lower alkoxy silanes include diallyl dimethoxy silane, allyl triethoxy silane, ethyl vinyl dimethoxy silane, divinyl diethoxy silane, vinyl triethoxy silane, and vinyl trimethoxy silane. In one embodiment of the invention, atmospheric pressure plasma is used to oxidize the vinyl group, creating peroxides that act as polymerization initiators for subsequent graft polymerization of monomers. Plasma may also be used to oxidize and create peroxides from other unsaturated groups, such as azides, carbonyls, etc. However, it is not necessary for the surface activation sites to be unsaturated groups, and any organic or inorganic group may be treated with plasma to create surface initiation sites for polymerization, including but not limited to surface radicals and peroxides.

In another significant embodiment of the invention, the surface of a polymeric substrate is modified by graft polymerization using an AP plasma. In principle, any organic or inorganic polymer can be treated according to the method of the present invention. Nonlimiting examples of organic polymers include polystyrene, polyamides, and polysulfones. The polymeric substrate is exposed to an AP plasma, which causes surface-bound active sites (polymer-initiation sites) to form on the substrate. Contacting the active sites with a monomer solution facilitates the formation and growth of polymer chains, which are covalently bound to the substrate through an active site moiety or moiety residue.

Surface modification of a polymeric substrate can utilize any of the plasma precursor gases listed above, optionally with a carrier gas. Typically, the surface of the polymeric substrate to be modified will be clean (i.e., substantially free of contaminants), but aggressive acids, such as piranha solution, will not generally be employed for this purpose. Instead, the substrate is simply immersed in or rinsed with one or more solvents, and then dried prior to AP plasma treatment. Conditioning in a humidity chamber is typically unnecessary, as active site formation results from the interaction between energetic plasma species and chemical moieties intrinsic to the polymeric substrate itself. However, water can be introduced into the plasma precursor and/or carrier gas stream(s) so as to provide for additional control of the formation of surface active sites, such as peroxides. The amount of adsorbed surface water, as well as the plasma power, treatment time, and other processing parameters are variable and can be controlled as necessary to maximize active site—and, ultimately, graft polymer—density.

Graft polymerization from a polymeric substrate can be carried out using a liquid monomer or monomer solution, with any desired unsaturated monomer. For example, graft polymerization of 1-vinyl-2-pyrrolidone (a polar vinyl monomer) was achieved, after AP plasma activation (using a hydrogen plasma), in an aqueous reaction mixture (20% v/v monomer concentration at 80° C.), and resulted in a thin, dense polymer film having a thickness of about 80 angstrom after 2 h. Similarly, graft polymerization of methacrylic acid (an ionic vinyl monomer) was achieved, after AP plasma activation (using a hydrogen plasma), in an aqueous methacrylic acid solution (20% v/v monomer concentration at 60° C.), and resulted in a thin, dense polymer film having a thickness of about 40 angstrom at after 2 h.

Modifying polymeric surfaces by atmospheric pressure plasma-induced graft polymerization according to the invention allows one to impart greater surface adhesion to polymeric materials; to control surface wetting, water resistance, and solvent resistance for plastic materials; to engineer surface chemical functionality, chemical selectivity, and surface topology for chemical sensors; to increase wear resistance; to improve biocompatibility for medical devices; and to decrease surface fouling (e.g, organic fouling, biofouling, and mineral salt scaling) for separation membrane applications.

EXAMPLES

Using the materials and methods described below, several nano-structured silicon, organic-functionalized, and polymeric substrates were prepared in accordance with the invention (Table 1).

TABLE 1

Examples

| Ex. | Substrate | Monomer | Solvent | Polymerization Technique |
|---|---|---|---|---|
| 1 | silicon | 1-vinyl-2-pyrrolidone | DI water | FRGP |
| 2 | silicon | 1-vinyl-2-pyrrolidone | 1-methyl-2-pyrrolidone | FRGP |
| 3 | silicon | 1-vinyl-2-pyrrolidone | DI water/1-methyl-2-pyrrolidone | FRGP |
| 4 | silicon/vinyl trimethoxysilane | 1-vinyl-2-pyrrolidone | DI water | FRGP |
| 5 | silicon/vinyl trimethoxysilane | 1-vinyl-2-pyrrolidone | 1-methyl-2-pyrrolidone | FRGP |
| 6 | polysulfone | 1-vinyl-2-pyrrolidone | DI water | FGRP |
| 7 | silicon | styrene | chlorobenzene | FRGP |
| 8 | silicon | styrene | chlorobenzene | NMGP |
| 9 | silicon | styrene | toluene | FRGP |
| 10 | silicon | vinyl acetate | ethyl acetate | FRGP |
| 11 | silicon/vinyl trimethoxysilane | vinyl acetate | ethyl acetate | FRGP |
| 12 | silicon/vinyl trimethoxysilane | 4-vinyl pyridine | methoxy propanol | FRGP |
| 13 | aromatic polyamide | methacrylic acid | DI water | FRGP |
| 14 | aromatic polyamide | acrylic acid | DI water | FRGP |

Materials. Prime-grade silicon <100> wafers were obtained from Wafernet, Inc. (San Jose, Calif.). Native wafer samples were single-side polished and cut into 1×1 or 2×2 cm square pieces for processing. De-ionized (DI) water was produced using a Millipore (Bedford, Mass.) Milli-Q filtration system. Hydrofluoric acid, sulfuric acid, aqueous hydrogen peroxide (30%), technical grade hydrochloric acid, chlorobenzene (99%), and tetrahydrofuran were purchased from Fisher Scientific (Tustin, Calif.). Anhydrous n-methyl-2-pyrrolidone (99.5%), reagent grade toluene, and tetrahydrofuran were obtained from Fisher Scientific (Tustin, Calif.). 1-Vinyl-2-pyrrolidone (99%) with sodium hydroxide inhibitor (<0.1%) was used as received and was obtained from Alfa Aesar (Ward Hill, Mass.). Styrene (99%) with catechol inhibitor (<0.1%), obtained from Sigma Sldrich (St. Louis, Mo.), was purified by column chromatography using a silica column (Fisher Scientific, Tustin, Calif.). Aqueous ammonium hydroxide (50%) was purchased from LabChem, Inc. (Pittsburgh, Pa.). 2,2,6,6-Tetramethyl-1-piperidinyloxy radical (TEMPO, 98%), obtained from Sigma Aldrich (St. Louis, Mo.), was used for surface radical determination and as a control agent for nitroxide-mediated graft polymerization.

Silicon Surface Preparation. Silicon substrates were subjected to a multi-step surface cleaning and conditioning process to remove surface contaminants and the native oxide layer on as-received wafers. Substrates were cleaned in piranha solution (7:3 (v/v) sulfuric acid/hydrogen peroxide) (Ex. 1-3, 7-10) for 10 minutes at 90° C. and then triple rinsed to remove residuals. Substrates were then dipped in a 20% (v/v) aqueous solution of hydrofluoric acid to remove the native oxide layer, and then triple rinsed as before. For hydrophilic (i.e., polar) vinyl monomer graft polymerization (Ex. 1-3), the silicon substrates were immersed in 1% (v/v) aqueous hydrochloric acid at ambient temperature for 8 h and then placed in DI water for 1 h to fully hydroxylate the silicon surface (i.e., to create surface hydroxyls, which increase the hydrophilicity of the wafer surface). Hydrolyzed silicon wafers were then oven dried under vacuum at 100° C. for 10 h to remove surface water. For hydrophobic (i.e., non-polar) polymerization (Ex. 7-10), surface hydrolysis was not required.

Silylated Silicon Surface Preparation. Silicon substrates were silylated (Ex. 4-5, 11-12) by first cleaning in piranha solution (7:3 (v/v) sulfuric acid/hydrogen peroxide) for 10 minutes at 90° C. and then triple rinsed to remove residuals. Substrates were then dipped in a 20% (v/v) aqueous solution of hydrofluoric acid to remove the native oxide layer, and then triple rinsed as before. The silicon substrates were immersed in 1% (v/v) aqueous hydrochloric acid at ambient temperature for 8 h and then placed in DI water for 1 h to fully hydroxylate the silicon surface (i.e., to create surface hydroxyls, which increase the hydrophilicity of the wafer surface). Hydrolyzed silicon wafers were then oven dried under vacuum at 100° C. for 10 h to remove surface water. Hydrolyzed silicon surfaces were silylated (Ex. 4-5, 11-12) by immersion in a 10% (v/v) mixture of vinyl trimethoxysilane in toluene and allowed to react for the desired period (typically not longer than 24 hours) at ambient temperature. Silylated silicon substrates were sonicated in toluene, washed in tetrahydrofuran, and dried overnight in a vacuum oven.

Polymer Surface Preparation. Polymeric substrates (Ex. 6, 13, 14) were generally cleaned by a stream of nitrogen gas to remove surface adsorbed particles.

Graft Polymerization of Silicon. Graft polymerization from the AP plasma-treated surfaces on silicon was achieved by immersing the substrates in a monomer solution. For graft polymerization of 1-vinyl-2-pyrrolidone (Ex. 1-3), initial monomer concentrations of 10-50% (v/v) were used for graft polymerization in water solvent (Ex. 1), and n-methyl-2 pyrrolidone solvent (Ex. 2). Also, graft polymerization of 1-vinyl-2-pyrrolidone was demonstrated on silicon for an initial monomer concentration of 30% (v/v) in a mixture of water and n-methyl-2-pyrrolidone (Ex. 3). The pH for aqueous polymerization reaction mixtures was adjusted with ammonium hydroxide to reduce side reactions. The temperature of the reaction mixture was maintained at 80° C. (±1° C.) and each reaction was allowed to proceed for a period of at least 8 h. Following the reaction, the surface modified silicon substrates were triple-rinsed in DI water and then sonicated to remove potentially adsorbed homopolymer. Cleaned substrates were then oven dried overnight under vacuum at 100° C. In Ex. 2, surface chain coverage, observed by Atomic Force Microscopy, demonstrated a thin dense polymer film with a film thickness of about 55 angstrom, polymer chain spacing in the range of 5-10 nm, and an average feature diameter of about 17 nm. Other results are presented below.

In Ex. 7 and 9, the hydrogen plasma-treated silicon substrates were grafted in a mixture of styrene in chlorobenzene (Ex. 7) and toluene (Ex. 9) solution, with an initial monomer concentration range of 10-50% (v/v) at T=70° C., 85° C., and 100° C. Following the reaction, the surface modified silicon substrates were sonicated in toluene, cleaned in tetrahydrofuran, and dried in a vacuum oven. Polymer film thickness, measured by ellipsometry, demonstrated steady polymer film thickness for surface modification at an initial monomer concentration of 30% (v/v) in chlorobenzene at 70 and 85° C. The polymer film thickness for the grafted film at 30% (v/v) styrene at 85° C. after 20 h was 120 angstrom. The rate of polystyrene film growth was dependent on the reaction temperature and initial monomer concentration, but graft polymerization at 30 and 50% (v/v) styrene at 100° C. resulted in poor control over film growth and heterogeneous surface topology.

In Ex. 8, the substrates were grafted in a 50% mixture of styrene in chlorobenzene solution at a temperature range of 100-130° C. (120° C.) and TEMPO control agent concentration of 5-15 mM, at a reaction time of 72 h. Following the reaction, the polymer-modified silicon substrates were sonicated to remove surface adsorbed homo-polymer, rinsed in tetrahydrofuran, and dried at 100° C. In Ex. 8, controlled and improved surface chain growth was accomplished by plasma-initiated nitroxide mediated graft polymerization with styrene in chlorobenzene with TEMPO control agent at [T]=5-15 mM at a reaction temperature of 120° C., initial monomer concentration of 50% v/v and a reaction period of 72 h. The polymer film growth for controlled nitroxide mediated graft polymerization increased linearly with time at [T]=10 mM, reaching a film thickness of about 280 angstrom. In addition, the surface roughness was 0.52 nm, which is similar to the surface roughness expected for smooth native silicon wafers. Linear polymer film growth with time and a low surface roughness indicates that the plasma-induced nitroxide graft polymerization is a controlled free-radical polymerization reaction.

In Ex. 10, the hydrogen plasma-treated silicon substrates were grafted in a mixture of vinyl acetate in ethyl acetate, with an initial monomer concentration range of 10-30% (v/v) at T=50° C., 60° C., and 70° C.

Graft Polymerization of Silylated Silicon. Silylated silicon substrates (Ex. 4,5,11,12) were graft polymerized by plasma surface treatment and immersion in a monomer solution. Graft polymerization of 1-vinyl-2-pyrrolidone was achieved over a monomer concentration range of 10-50% (v/v) at 80° C. for a period of 8 h in both a DI water solvent (Ex. 4) and n-methyl-2-pyrrolidone (Ex. 5). Following the reaction, the modified surface was cleaned in DI water then sonicated to remove potentially adsorbed homopolymer. Cleaned substrates were then oven dried overnight under vacuum at 100° C. Silylated silicon was also modified by vinyl acetate (Ex. 11) and vinyl pyridine (Ex. 12). Vinyl acetate graft polymerization was conducted at 30% (v/v) monomer concentration in ethyl acetate at 60° C. for a period of 8 h. Vinyl pyridine graft polymerization was conducted at 30% (v/v) monomer concentration in methoxy propanol at 80° C. for a period of 8 h.

Graft Polymerization of Polymer Surfaces. Polysulfone (Ex. 6) was modified by plasma-induced graft polymerization of 1-vinyl-2-pyrrolidone in DI water. The initial monomer concentration was 20% (v/v) at 70° C. for a period of 2 h. Polyamide was also modified by plasma-induced graft polymerization of methacrylic acid (Ex. 13) and acrylic acid (Ex. 14) in DI water. The initial monomer concentration was in the range of 5-20% (v/v) over a temperature range of 50-70° C. for a period of 2 h for both monomers. The film thickness that was achieved for grafting polymethacrylic acid from polyamide surfaces was about 40 angstrom at 20% (v/v) monomer concentration for 2 h at 60° C.

Surface Initiator Determination. The presence and relative abundance of surface radicals that are farmed during plasma treatment were determined using 2,2,6,6-tetramethyl-1-piperidinyloxy (TEMPO), a well known free-radical scavenger that covalently bonds to silicon surface radicals. The presence of surface-bound TEMPO (as detected by FTIR) served as an indirect measure of the density of surface radicals. For example, silicon substrates (1×1 cm) were plasma treated and immediately immersed in a solution of 0.1 mM TEMPO dissolved in n-methyl-2-pyrrolidone and allowed to react over a 24 h period at 90° C. The substrates were then removed and sonicated in tetrahydrofuran for two hours to remove surface adsorbed TEMPO and finally oven dried under vacuum at 100° C. for a sufficient period of time to remove residual solvent.

Grazing Angle FTIR spectroscopy was used to detect the surface-bound TEMPO by collecting spectra from at least 3 locations for each wafer. The presence of TEMPO was confirmed by FTIR absorption peaks at 3019 $cm^{-1}$ and 1100 $cm^{-1}$ for aromatic carbon atoms and nitroxide functional soups, respectively. The absorbance spectrum was compared with the solution concentration to develop the linear calibration curve between concentration and absorbance over the initial TEMPO concentration range of 1.0-0.001 mM.

Surface Characterization. Surface analysis by Fourier Transform Infrared (FTIR) Spectroscopy was carried out using a Bio-Rad FTS-40 with a grazing angle attachment (Varian Digilab Division, Cambridge, Mass.) (Ex. 13) or Attenuated Total Reflectance Fourier Transform Infrared (ATR-FTIR) spectroscopy using a BioRad FTS-40 FTR equipped with an Attenuated Total Reflectance accessory (BioRad Digilab Division) (Ex. 4 and 5). Grazing angle IR spectra for TEMPO-reacted surfaces and plasma-treated surfaces were processed by subtraction from the spectra for clean, native substrates. Resulting spectra were represented in Kubelka-Munk units which have absorbance values that are proportional to the surface species concentration.

Contact angle measurements for the poly(vinyl pyrrolidone) grafted substrate surfaces were obtained by the sessile-drop method with a Kruss Model G-23 contact angle instrument (Hamburg, Germany). Before the measurements, each polymer-grafted substrate was rinsed and sonicated separately in tetrahydrofuran and then DI water, each for 15 min. The polymer-grafted substrate was subsequently oven-dried under vacuum at a suitable temperature to promote drying but avoid thermal damage to the substrate and the grafted polymer layer. For example, 30 min drying time at 80° C. was adequate for the poly(vinyl pyrrolidone) grafted silicon wafer. Contact angle measurements were made using DI water at 40-50% relative humidity and 22° C. Each contact angle datum was obtained by averaging the results from 5 separate drops on different areas of a given surface. The size and volume of the drops were kept approximately constant to reduce variations in contact angle measurements.

The film thickness of the plasma treated surface and the polymer grafted substrates was determined using a Sopra GES5 Spectroscopic Ellipsometer (SE) (Westford, Mass.). The broadband variable angle SE was operated over a range of 250-850 nm and the ellipsometric data collected were fitted to user defined multi-layer film models with the film thickness calculated through the use of the Levenberg-Marquardt regression method. Each measurement was averaged over five locations on the substrate and the standard deviation did not exceed 10%.

Atomic Force Microscopy (AFM) imaging was performed using a Multimode AFM with a Nanoscope IIIa SPM controller (Digital Instruments, Santa Barbara). All AFM scans were taken in tapping mode in ambient air using NSC15 silicon nitride probes (Digital Instruments, Veeco Metrology Group, Santa Barbara, Calif.) with a force constant between 20-70 N/m, a nominal radius of curvature of 5-10 nm and a side angle of 20°. AFM scans (1×1 μm) on silicon substrates were taken at a scan rate of 0.5-1 Hz. At least five locations were sampled for each modified substrate, with two scans taken for each location. Surfaces were imaged at 0 and 90° to ensure that images were free of directional errors. Height data and phase data were taken simultaneously for the same scan area. Root-mean-square (RMS) surface roughness was determined directly from height data for 1×1 μm scans where $R_{rms}$ is the RMS roughness, $Z_i$ is the ith height sample out of N total samples, and $Z_{avg}$ is the mean height.

$$R_{rms} = \sqrt{\frac{\sum (Z_i - Z_{avg})^2}{N}} \quad (1)$$

The skewness, $S_{skew}$, which is a measure of the asymmetry of the height distribution data about the mean, was determined from $$S_{skew} = \frac{\sum (Z_i - Z_{avg})^3}{(N-1)\sigma^3} \quad (2)$$

where σ is the standard deviation. Polymer volume for the graft polymerized surfaces was determined over a 1×1 μm area by volume integration over the crafted polymer area with respect to the z-height profile of the polymer surface features. To minimize the contribution of native surface features to the grafted polymer volume, the average Z-height of the native substrate surface, determined from five locations for each surface, was subtracted from the surface feature height data when integrating to obtain the total grafted polymer volume. For determining the height distributions of the modified surfaces, the Z-height data used for polymer volume measurements was compared to a Gaussian distribution in order to clarify the presence of tails (small or large features) in the distribution. Feature spacing and average feature diameter were determined by measurements taken from ten different locations over a 1×1 μm area, whereby feature boundaries were defined based on digital image pixel analysis.

Consistent with previous studies on plasma activation of polymeric substrates, the resulting surface density of surface initiation sites was, in part, determined by the plasma treatment time and the radio frequency (RF) power. However, it was found that, for inorganic substrates, formation of a high density of active sites (and, hence, a dense graft polymer layer) required careful control of the amount of water adsorbed on the surface of the substrate. Adsorbed surface water was not required with polymeric substrates. The combined effect of plasma surface treatment and adsorbed surface water on the generation of surface initiation sites was evaluated using a TEMPO binding assay.

Figure 3:
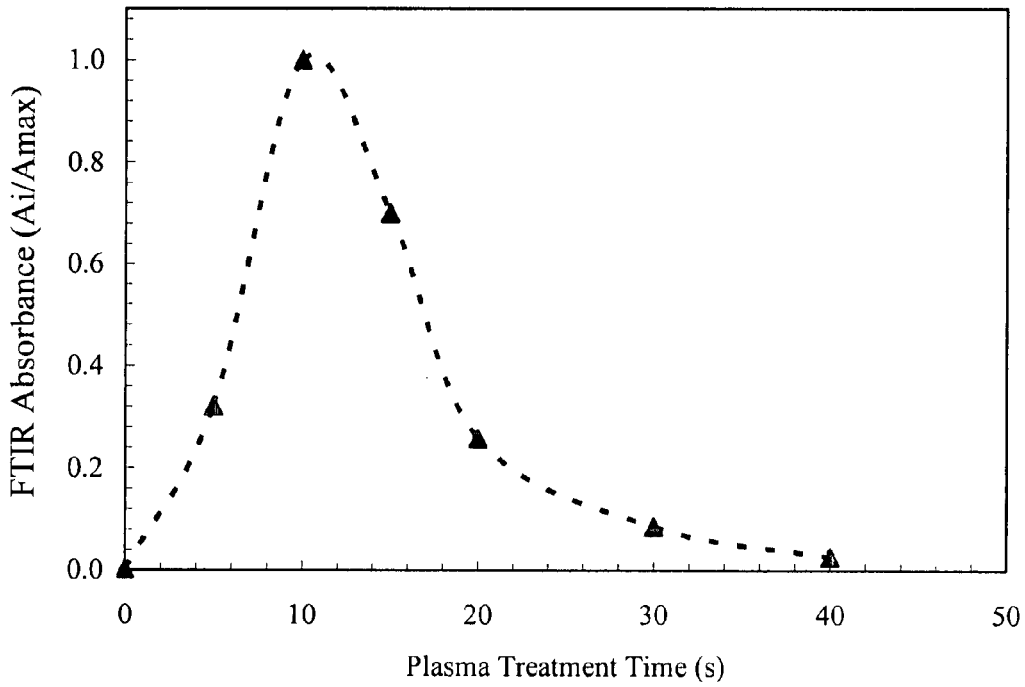
FIG. 3 is a plot showing the effect of plasma treatment time on the presence of surface radicals (detected using TEMPO binding assay with FTIR analysis) formed by atmospheric pressure plasma surface treatment (RF power=40 W, RH=50% at 22° C.) according to one embodiment of the invention.

The presence of surface radical species generated by AP hydrogen plasma surface treatment of the substrates was verified using the TEMPO binding assay. The impact of both plasma treatment time and RE power were first evaluated to select the optimal plasma treatment conditions. The surface density of radical species, as suggested by the TEMPO surface binding analysis, increased with plasma exposure times according to a power law dependence as illustrated in FIG. 3 up to a maximum coverage that was reached at 10 s treatment time (RF power of 40 W). For the silicon substrate, extending the plasma treatment time beyond 10 s resulted in a similar decline in radical surface coverage by more than 70% and 90% at 20 and 30 s exposure periods, respectively. These findings are in general agreement with other studies performed on organic materials in which an optimal plasma exposure treatment time was found which maximized surface radical density. This behavior is due to surface radical formation and subsequent passivation, leading to removal or inactivation of surface initiators as the residence time of hydrogen plasma species is increased at the surface. However, it should be noted that the treatment time interval necessary for optimal surface radical formation using low pressure plasma activation of polymeric materials was reported to be significantly longer than for AP plasma treatment of inorganic surfaces: 180 s for argon plasma treatment of polyethylene, 60 s for argon plasma treatment of polyacrylic acid, and 30 s for oxygen plasma treatment of polyurethane.

Figure 4:
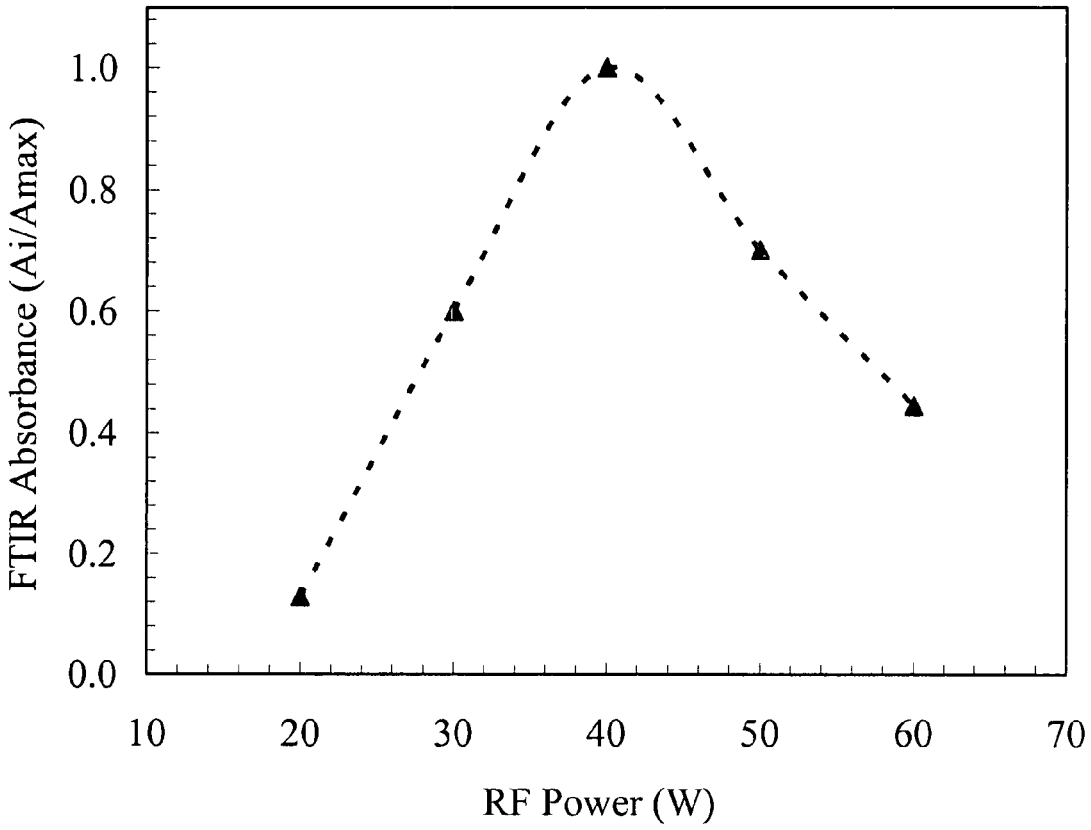
FIG. 4 is a plot showing the effect of plasma radio frequency (RF) power on the presence of surface radicals (detected using TEMPO binding assay with FTIR analysis) formed by atmospheric pressure plasma surface treatment (treatment time=10 sec, RH=50% at 22° C.) according to one embodiment of the invention.

RF plasma power had a qualitatively similar effect as treatment time on the formation and surface coverage of radical initiator sites as shown in FIG. 4. The site density of surface radicals increased with RF plasma power to a maximum reached at RF power of 40 W (treatment time of 10 s) and then decreased slowly with a further increase in the RF power. In plasma processing, an increase in RF plasma power leads to increased electron-atom collisions in the gas phase, generating a higher density of reactive species in the plasma gas and therefore at the substrate surface. Thus, similar to the impact of increased plasma treatment time, radicals that were created on the surface were subsequently passivated by overexposure to plasma species.

Consideration of the surface chemistry involved in stabilization of surface radicals on inorganic substrates led to further strategies which improved surface radical number density. While the chemical surface properties of polymeric surfaces allow for the formation of pseudo-stable initiation sites (e.g., epoxides) upon plasma treatment, inorganic surface radicals are unstable and undergo molecular rearrangements such as atomic recombination and/or decomposition to form non-radical dormant species. To maintain surface activity (for subsequent graft polymerization) for a sufficiently long period, it was found in the present study that adsorbed surface water was critical in the formation and stabilization of inorganic substrate surface radicals. Although not bound by theory, it is postulated that the beneficial role of adsorbed surface water may be the result of the reaction of surface radicals with water to form surface peroxides or possibly due to stabilization of the silicon radical through hydrogen bonding with water. Accordingly, the impact of surface water on the creation of surface initiation sites was evaluated in a series of experiments in which the degree of surface water coverage was varied by equilibrating the substrate in a humidity controlled chamber.

Figure 5:
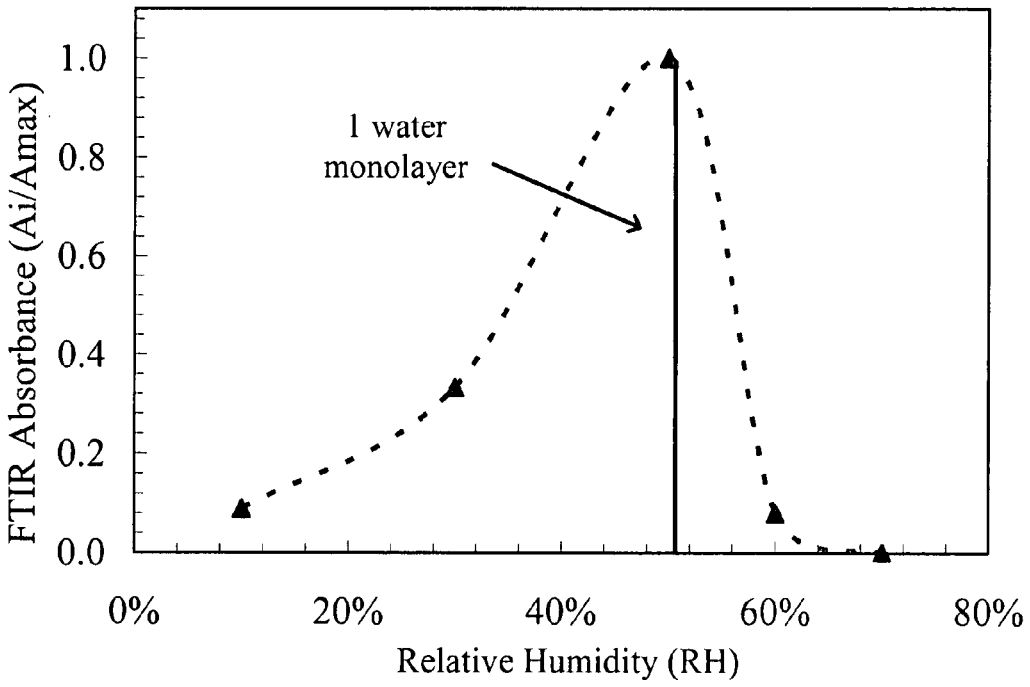
FIG. 5 is a plot showing the effect of absorbed surface water coverage on the presence of surface radicals (detected using TEMPO binding assay with FTIR analysis) formed by atmospheric pressure plasma surface treatment (treatment time=10 see and RF power=40 W) according to one embodiment of the invention.

As shown in FIG. 5, the density of surface radicals, as implied by the TEMPO binding analysis, increased with increasing adsorbed surface water coverage up to a maximum at 50% relative humidity (% RH) at 22° C. (for the optimal plasma exposure of 10 s at RF power of 40 W). As previously noted elsewhere, for fully hydroxylated silica surfaces with a silanol concentration of 7.6 μmoles/$m^2$, the formation of a single adsorbed monolayer of water occurs at about 51% RH at 22° C., assuming a 1:1 surface water to silanol ratio. Thus, it may be inferred that the maximum density of surface active sites obtained in the present study at 50% RH corresponded to approximately a single monolayer coverage of surface water. At surface water coverage above a monolayer, a significant decrease of 90% in surface radical density occurred as the relative humidity increased from 50% to 60%. It is noted that the atomic radius of a hydrogen plasma species is approximately 0.5 Å while the film thicknesses of adsorbed surface water for 1, 2 and 3 monolayers are 1.2, 2.7, and 4.3 Å, respectively. It is believed that as the surface water layer thickness increased, the water film became a physical barrier to plasma particles, thereby reducing direct interactions with the underlying surface. The above results illustrate that optimal control of surface water coverage on inorganic substrates, along with plasma treatment time and RF power, was essential for control of the density of surface initiation sites necessary for graft polymerization.

AFM imaging of the silicon wafers demonstrated that the RMS surface roughness of the native silicon wafer ($R_{rms}$=0.17 nm) was essentially unaltered following surface hydrolysis and AP plasma treatment ($R_{rms}$=0.20 nm) over a treatment period of 60 s. However, plasma treatment of the silicon substrate did result in an increased surface hydrophilicity as indicated by the decrease in water contact angle with increased plasma exposure period. It is noted, though, that at the optimal plasma activation exposure time for surface radical formation (treatment time=10 s), the contact angle of the plasma treated surface decreased by only 13% relative to that of the untreated surface (i.e., from 61° to 53°).

APPIG polymerization of 1-vinyl-2-pyrrolidone (VP) onto a silicon substrate (silicon-g-PVP) was initially conducted at the optimal surface plasma activation conditions (10 s plasma exposure period, RF power of 40 W, and 50% RH at 22° C.). The polymer modified surfaces were characterized by Atomic Force Microscopy with respect to surface feature number density and spacing, surface feature height distribution, RMS surface roughness ($R_{rms}$, eq 1) and polymer volume. Also, it was noted that the contributions of small features to surface roughness may be eclipsed by a lower density of larger surface features. Therefore, the distribution of polymer surface feature heights and skewness ($S_{skew}$, eq 2) were analyzed to provide a more descriptive characterization of surface topography.

APPIG polymerization on a plasma-treated silicon substrate was initially performed in an aqueous solvent (e.g., Ex. 1), which is the most commonly used media for polymerization of VP. Results of graft polymerization in an aqueous solvent (Table 2), where the initial monomer concentration was increased from $[M]_0$,=10%-50% (v/v), revealed grafted polymer volume that was maximized at about $[M]_0$=30%, with nearly a factor of nine increase in the polymer volume and an increase in surface roughness relative to $[M]_0$=10%. Further, the RMS surface roughness ($R_{rms}$=0.41 nm) of the surface grafted at $[M]_0$=30% was about a factor of 2.4 greater than the RMS roughness of the native silicon wafer. As the initial monomer concentration was increased above 30%, the polymer volume decreased by more than 50% at $[M]_0$=50%.

TABLE 2

| Reaction Condition | | | |
|---|---|---|---|
| $[M]_0$ v/v[(a)] | T (° C.) | $R_{rms}$ (nm) | Polymer Volume ($nm^3/\mu m^2$) ($10^3$) |
| 10 | 80 | 0.18 | 5.9 |
| 20 | 80 | 0.32 | 25.0 |
| 30 | 80 | 0.41 | 52.3 |
| 40 | 80 | 0.47 | 37.9 |
| 50 | 80 | 0.36 | 24.8 |

[(a)]Graft polymerization conducted in aqueous solvent.

Note:

Initial monomer concentrations of 10%, 20%, 30%, 40%, and 50% (v/v) are denoted in the text as M10, M20, M30, M40, and M50, respectively.

Figure 6:
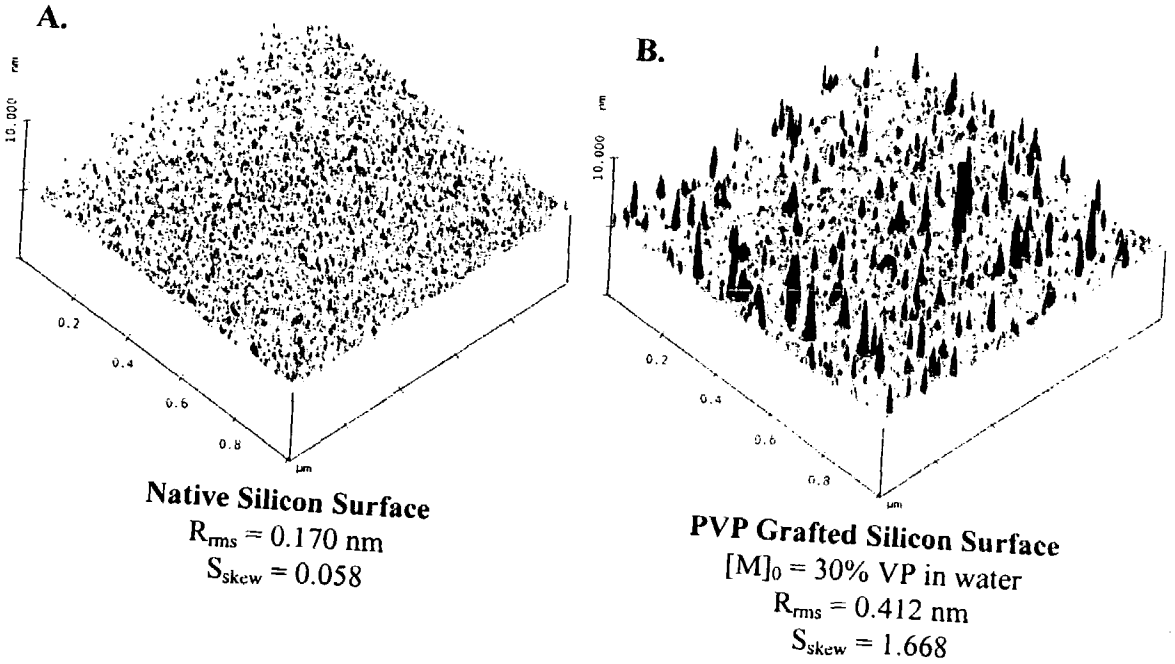
FIG. 6 is a pair of tapping mode AFM 3-D surface renderings of native and poly(vinyl pyrrolidone)-grafted silicon substrate at $[M]_0$=30% (v/v) VP in aqueous solvent with $R_{rms}$, surface roughness and skewness (1×1 μm sample areas) according to one embodiment of the invention.

Water contact angle measurements (not shown) of PVP-grafted surfaces in an aqueous solvent did not evidence a measurable change (<5%) in surface hydrophilicity due to the low surface coverage of grafted polymers. AFM imaging of the silicon-g-PVP wafers created in the above aqueous graft polymerization step was used to reveal the topography of the modified surfaces (FIG. 6). While these studies were useful in identifying the optimal monomer concentration for grafting at $[M]_0$=30%, AFM imaging suggested that the above grafting approach was not capable of producing high density surface grafting, which may have been due, in part, to the aqueous solvent. Water contact angle measurements of the hydrolyzed surface (61°) suggested a low degree of hydrophilicity, indicating poor solvent substrate surface wetting, which may have been insufficient for graft polymerization in the aqueous solvent. N-methyl-2-pyrrolidone (NMP), an organic solvent miscible in both monomer and substrate, was found to be a substitute solvent for DI water for improved grafting density. Contact angle measurements with NMP as the wetting agent demonstrated that the surface was completely wetted (<5°) by the organic solvent.

Figure 7:
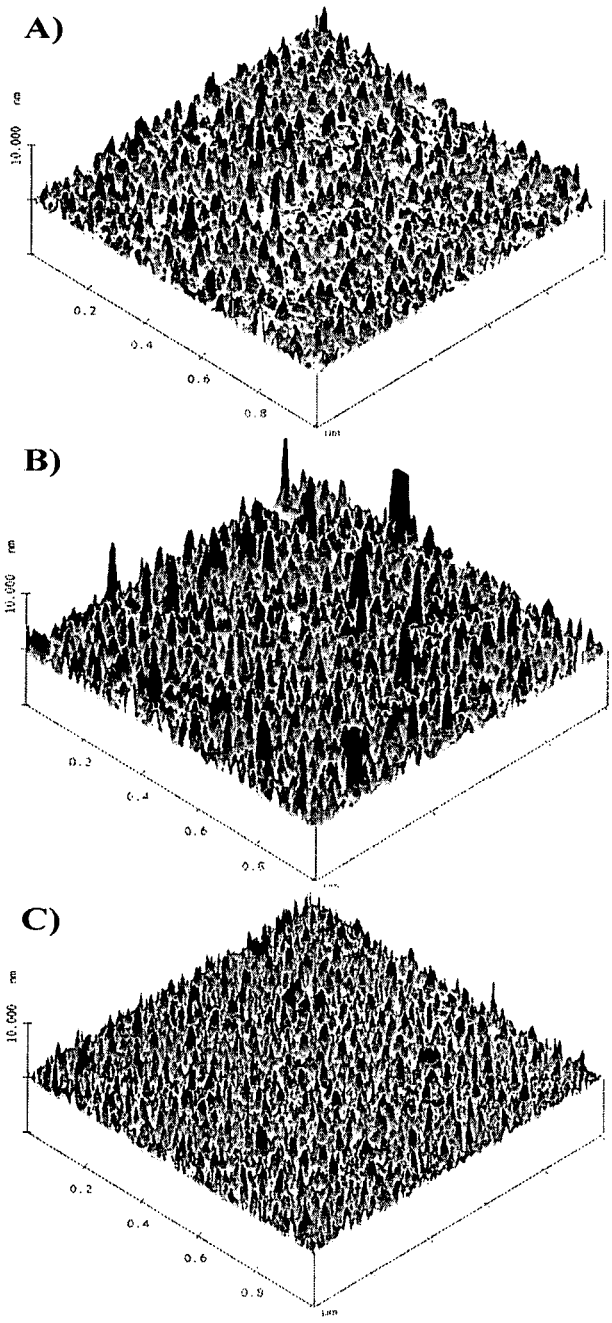
FIG. 7 is a set of tapping Mode AFM 3-D surface renderings of silicon surfaces graft polymerized with 1-vinyl-2-pyrrolidone in n-methyl-2-pyrrolidone at A) $[M]_0$=20%, B) $[M]_0$=30%, and C) $[M]_0$=40% (1×1 μm sample areas) according to one embodiment of the invention.

Graft polymerization in NMP indeed resulted in a higher density of surface grafted features as observed by AFM imaging (FIG. 7), evidencing a higher density of polymer chains as compared to graft polymerization in an aqueous solvent. PVP grafted surfaces obtained by graft polymerization in NMP demonstrated an increase in polymer volume with increasing initial monomer concentration (Table 3), up to a maximum obtained at $[M]_0$=30%, qualitatively consistent with studies performed in aqueous solvent. Surfaces grafted at $[M]_0$=30% as compared to those grafted at $[M]_0$=10% demonstrated both a 3-fold increase in polymer layer thickness and a corresponding decrease of 30% in water contact angle. The increase in grafted layer thickness with increasing initial monomer concentration is consistent with previous work on the kinetics of free radical graft polymerization of 1-vinyl-2-pyrrolidone that conclusively demonstrated a rise in surface polymer graft yield with initial monomer concentration. It was observed, however, that when the initial monomer concentration was increased above 30% (i.e. 40% and 50% as given in Table 2), there was a decrease in the grafted polymer volume by 60% and 75%, respectively. Although the polymer layer thickness obtained at $[M]_0$=40% decreased by about 51%, relative to the maximum thickness attained at $[M]_0$=30%, there was no apparent decrease in surface graft density of polymer features. The increase in layer thickness with initial monomer concentration (at approximately $[M]_0 \leq 30\%$) is as expected given the higher rate of monomer addition to growing chains (i.e., propagation). However, chain termination (due to both chain transfer and chain-chain termination) also increases with monomer concentration. Therefore, the film thickness should drop at high initial monomer concentrations as reported in Table 3. In principle, and as verified by data up to the initial monomer concentration of 40%, chain surface density appeared to be affected primarily by the creation of active surface sites by the plasma treatment process. Unexpectedly, however, at sufficiently high monomer concentration, as observed for $[M]_0$=50%, apparent feature spacing was reduced relative to $[M]_0$30% and 40%. Comparison of surfaces grafted in NMP solvent as opposed to an aqueous solvent demonstrated a striking difference in surface feature spacing. For example, for initial monomer concentration $[M]_0$=30%, grafting in NMP solvent resulted in surface feature spacing of 5 to 10 nm as compared to a range of 100 to 200 nm when grafting in an aqueous solvent. Moreover, relative to aqueous studies, graft polymerization in NMP resulted in more than a 160% increase in grafted polymer volume, a 75% increase in surface roughness and a significant increase in polymer graft density.

TABLE 3

| Reaction Condition | | | Surface | PVP | Polymer | Polymer |
|---|---|---|---|---|---|---|
| $[M]_0$ v/v[a] | Temperature (° C.) | Contact Angle (°) | Roughness, $R_{rms}$ (nm) | Layer Thickness (nm) | Volume ($nm^3/\mu m^2$) ($10^3$) | Feature Spacing (nm) |
| 10 | 80 | 54 | 0.18 | 1.74 | 20.1 | 25-35 |
| 20 | 80 | 43 | 0.42 | 2.27 | 49.9 | 5-20 |
| 30 | 80 | 38 | 0.72 | 5.50 | 138.9 | 5-10 |
| 40 | 80 | 49 | 0.38 | 2.70 | 85.3 | 5-10 |
| 50 | 80 | 51 | 0.26 | 2.32 | 35.4 | 20-30 |

[a]Graft polymerization conducted in pure n-methyl-2-pyrrolidone

It was found that, by adjusting the ratio of organic to aqueous media in the solvent mixture the surface morphology and polymer graft density could be uniquely tuned. As shown in Table 4, the average polymer feature diameter increased by nearly a factor of 9 at [NMP]=60% relative to pure aqueous solvent, and the feature spacing size decreased to a range of 10 to 50 nm, suggesting the formation of large, close proximity features on the surface. However, as the NMP:water ratio was further increased to [NMP]=80%, the feature diameter decreased by more than 50% and the feature spacing further decreased to a range of 5 to 20 nm, indicating the formation of a higher surface number density of smaller grafted polymer chains.

TABLE 4

| Reaction Condition | | Avg. Polymer Feature | Polymer Feature |
|---|---|---|---|
| [NMP] v/v | $[M]_0$ v/v[a] | Diameter (nm) | Spacing (nm) |
| 0 | 30 | 10.51 | 100-200 |
| 20 | 30 | 27.44 | 30-80 |
| 40 | 30 | 50.16 | 25-60 |
| 60 | 30 | 92.33 | 10-50 |
| 80 | 30 | 43.24 | 5-20 |
| 100 | 30 | 17.06 | 5-10 |

Figure 8:
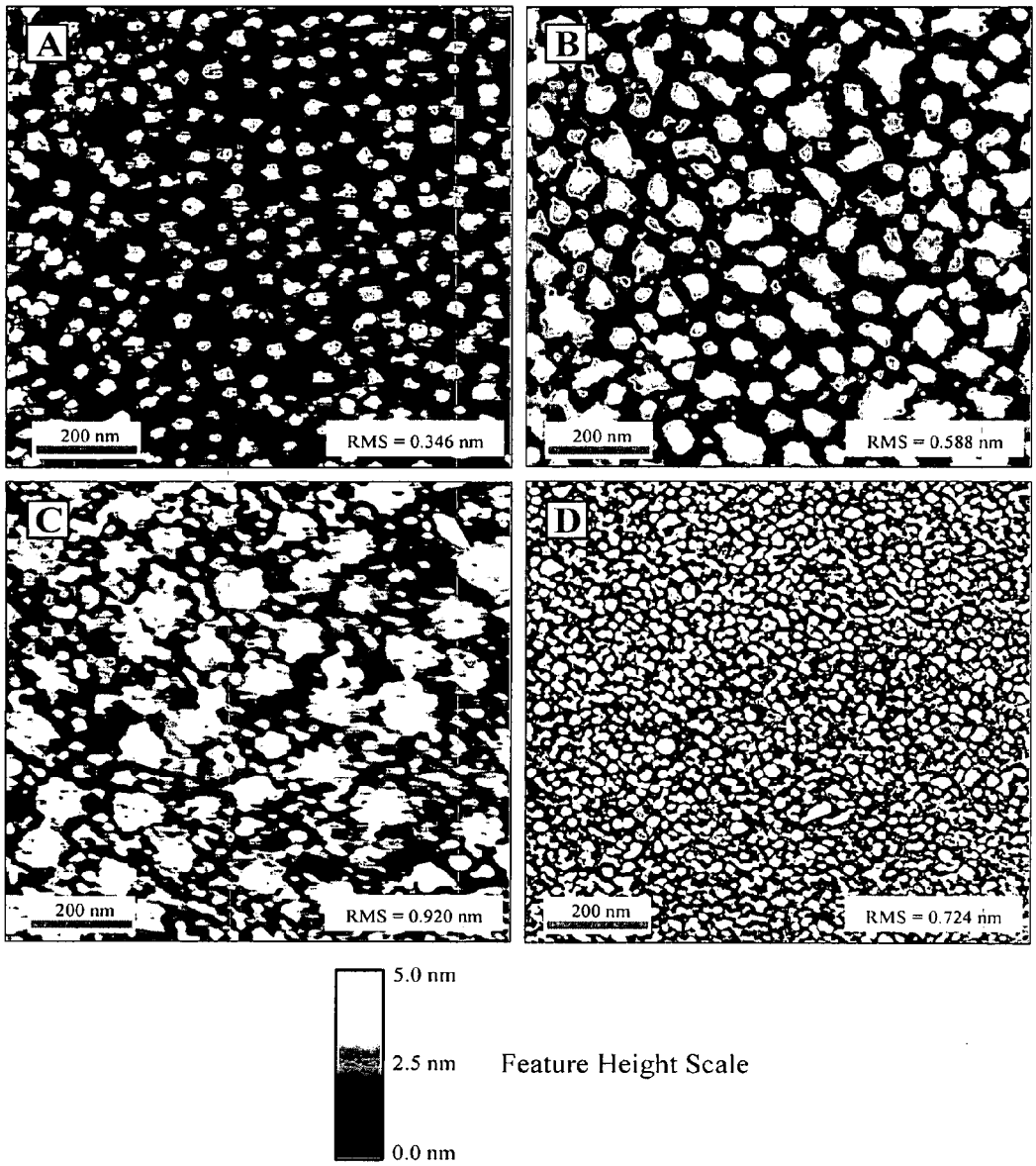
FIG. 8 is a set of tapping mode AFM images of silicon surfaces graft polymerized with 1-vinyl-2-pyrrolidone at $[M]_0$=30% (v/v) in a mixture of aqueous solvent and A) [NMP]=15%, B) [NMP]=40%, C) [NMP]=60% and D) [NMP]=100% (no water) (1×1 μm sample areas) according to one embodiment of the invention.

AFM images illustrate that the grafted PVP layer formed at [NMP]=60% (FIG. 8*c*) was composed of large clusters of grafted polymers compared to smaller grafted polymer features that resulted from grafting at [NMP]=40% (FIG. 8*b*) as well as at [NMP]=15% (FIG. 8*a*). For a low NMP:water mixture ratio, the modified surfaces were characterized by a homogeneous distribution of uniformly distributed surface features. As the NMP:water mixture ratio increased to [NMP]=60%, a distinct mixture of small and large spherical polymer islands were formed, as noted by AFM imaging. Also, there was a significant increase in RMS surface roughness from $R_{rms}$=0.35 nm at [NMP]=15% to $R_{rms}$=0.92 nm at [NMP]=60%. These findings suggest that the surface morphology of the grafted polymers can be tuned by altering the solvent-substrate wetting properties.

Figure 9:
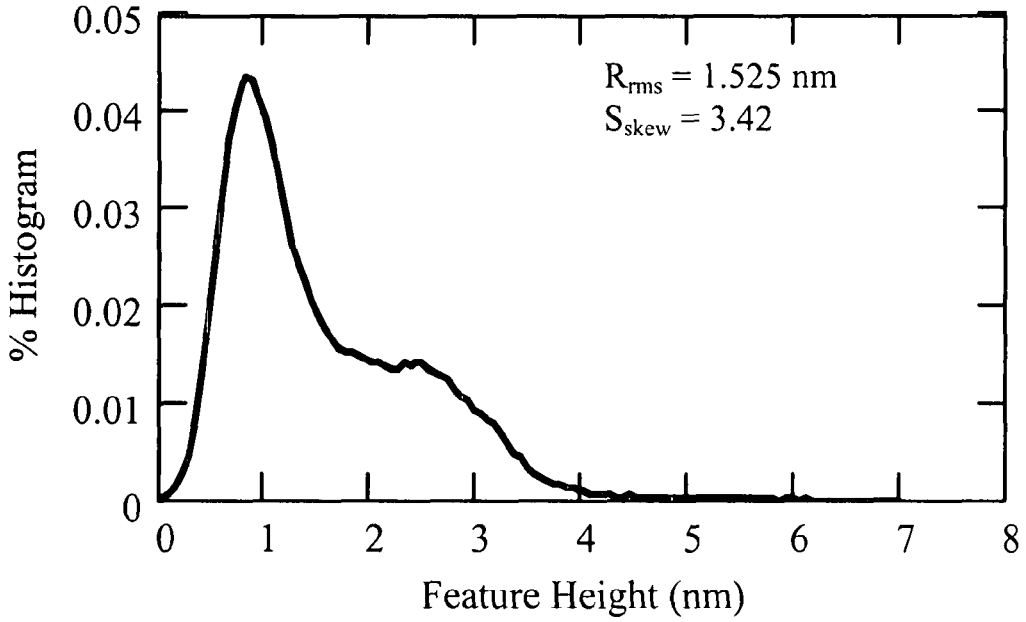
FIG. 9 is a pair of height histograms of 1-vinyl-2-pyrrolidone (PVP)-grafted silicon wafers prepared by graft polymerization of 1-vinyl-2-pyrrolidone at $[M]_0$=30% (v/v) and solvents A) [NMP]=60% and B) [NMP]=100% (treatment time=10 sec, RF power=40 W, and RH=50% at 22° C.) according to one embodiment of the invention.
Figure 9:
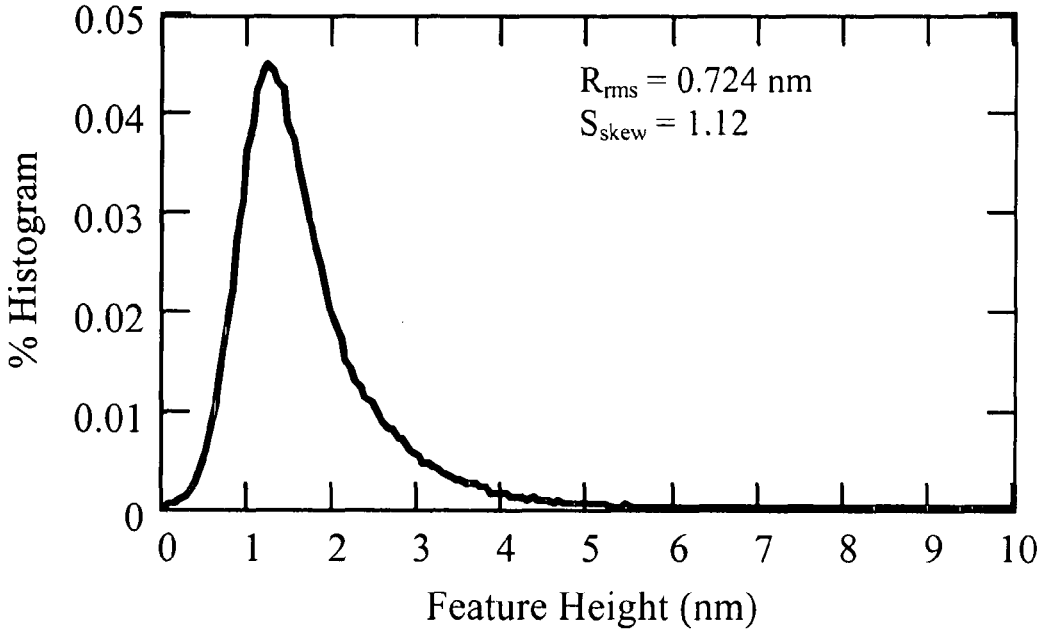

The effect of NMP on the topology of the high surface density (i.e. polymer feature spacing>50 nm) grafted polymer layers can be conveniently illustrated by inspecting the height histograms of the polymer surface features. As a comparison, the height histograms for the grafted PVP layers formed in NMP/water mixtures of [NMP]=60% and [NMP]=100% at $[M]_0$=30% are shown in FIGS. 9*a* and 9*b*, respectively. While previous results noted an increased surface roughness for grafting at [NMP]=60% ($R_{rms}$=1.52 nm) compared to [NMP]=100% ($R_{rms}$=0.72 nm), the surface feature height histogram clearly reveals that the grafted polymer surface formed at [NMP]=60% has a bimodal feature height distribution. This may be expected when considering the shape, morphology and height of the polymer surface features imaged by AFM at [NMP]=60% (FIG. 8*c*) as compared to [NMP]=100%. The bimodal distribution may be characterized by smaller features in the size range below 1 nm and larger clusters in the range of 1-8 nm (FIG. 9*a*). While smaller features contribute to the overall number density of surface features, larger features that appear as polymer clusters make a disproportionately large contribution to the RMS surface roughness due to the increased diameter or surface area of the features (eq 1). It is hypothesized that the large polymer clusters or aggregates formed as the result of non-uniform surface wetting by the NMP/water mixture solvent. In contrast, grafting in pure NMP resulted in a continuous single mode distribution of surface features height with $S_{skew}$=1.12 (FIG. 9*b*) relative to skewness of $S_{skew}$=3.42 for grafting at [NMP]=60% (FIG. 9*a*). The above results demonstrate that 1-vinyl-2-pyrrolidone graft polymerization in pure NMP resulted in a narrower size distribution of tethered chains relative to the NMP/water mixtures.

These data demonstrate that the topology of the grafted polymer layer can be controlled by the proper selection of reaction conditions and water/NMP mixture composition, thereby enabling a wide-range of potential practical applications.

Plasma-Induced FRGP Layer Growth of Polystyrene on Silicon. In Ex. 7 and 9, polystyrene was chemically grafted to silicon substrates using a two-step approach consisting of AP plasma surface initiation and free radical graft polymerization (FRGP). Synthesis of polystyrene grafted silicon by plasma surface initiation was confirmed by ATR-FTIR spectroscopic analysis. With FRGP, monomer initiation by plasma-induced graft polymerization of styrene occurs by plasma surface initiation and thermal solution initiation. In the former, monomer initiation is achieved at relatively low reaction temperatures (T~70° C.) by formation of surface radicals by plasma surface treatment, from which monomer addition can occur. In the latter, monomer decomposition and polymerization in solution (T≥100° C.) results in the formation of macroradicals which may remain in solution or compete with monomer for grafting to activated surface sites. Therefore, we considered grafted polymer chain growth by both initiation pathways and in the transition regime by studying grafting at the following conditions: Regime I=70° C., Regime II=85° C., and Regime III=100° C.

Figure 10:
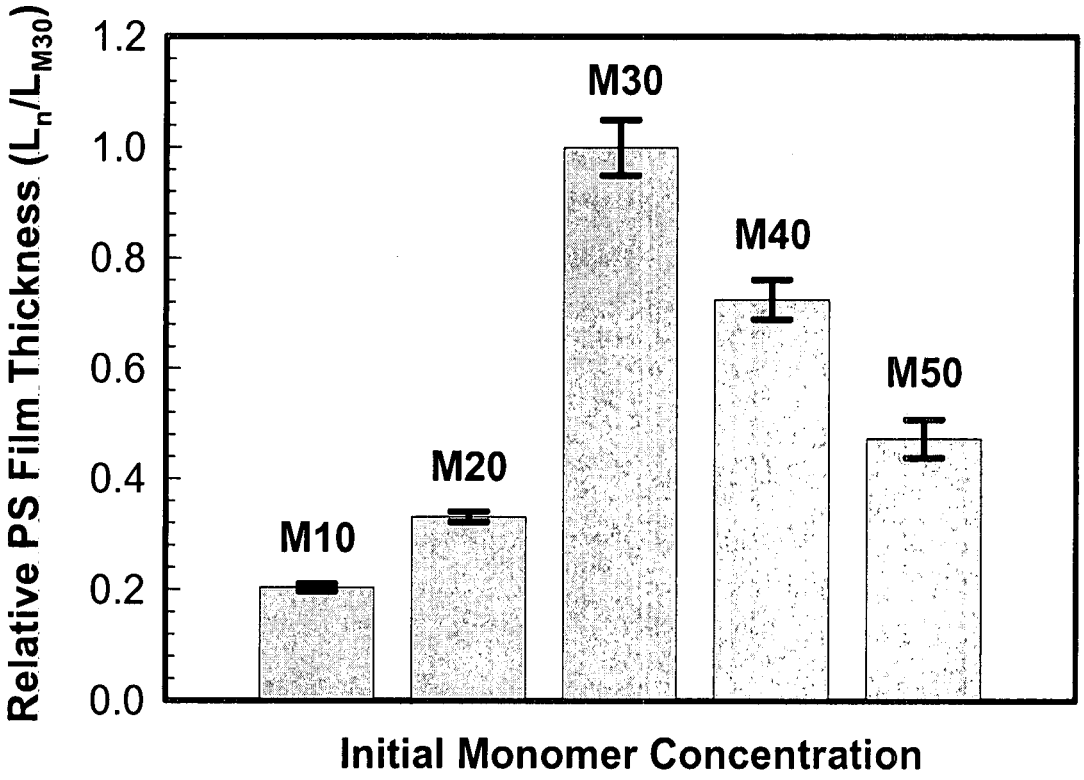
FIG. 10 is a plot showing relative polystyrene film thickness for APPIGP of styrene at initial monomer concentration M10-M50 at T=85° C. and t=8 h ($L_{M30}$=film thickness at M30) according to one embodiment of the invention.

The grafted polystyrene surface initiator and polymer chain density was dependent on the plasma processing parameters (i.e., treatment time, RF power, surface conditioning), as noted earlier, and the surface-bound polymer chain length (i.e., polymer brush thickness) was dependent on the initial monomer concentration and reaction temperature, as described in the established mechanism for FRGP. Plasma-induced graft polymerization of polystyrene, over an initial monomer concentration range of 10-50 vol. %, resulted in maximum layer growth for the M30 grafted silicon, as shown in FIG. 10. Further increase in initial monomer concentration resulted in a decrease in total layer growth by more than 25% and 50% for the M40 and M50 substrates, respectively.

[Elevated reaction temperatures for M30 in Regime II led to an increase of more than 3.6 times in grafted polymer layer thickness, attributed to the increased initiation and grafting efficiency leading to polymer brush layer growth. Graft polymerization for M30 in Regime III resulted in a 36% decrease in grafted polymer layer thickness, with respect to grafting in Regime II, in addition to layer growth termination within 5 h.

Figure 11:
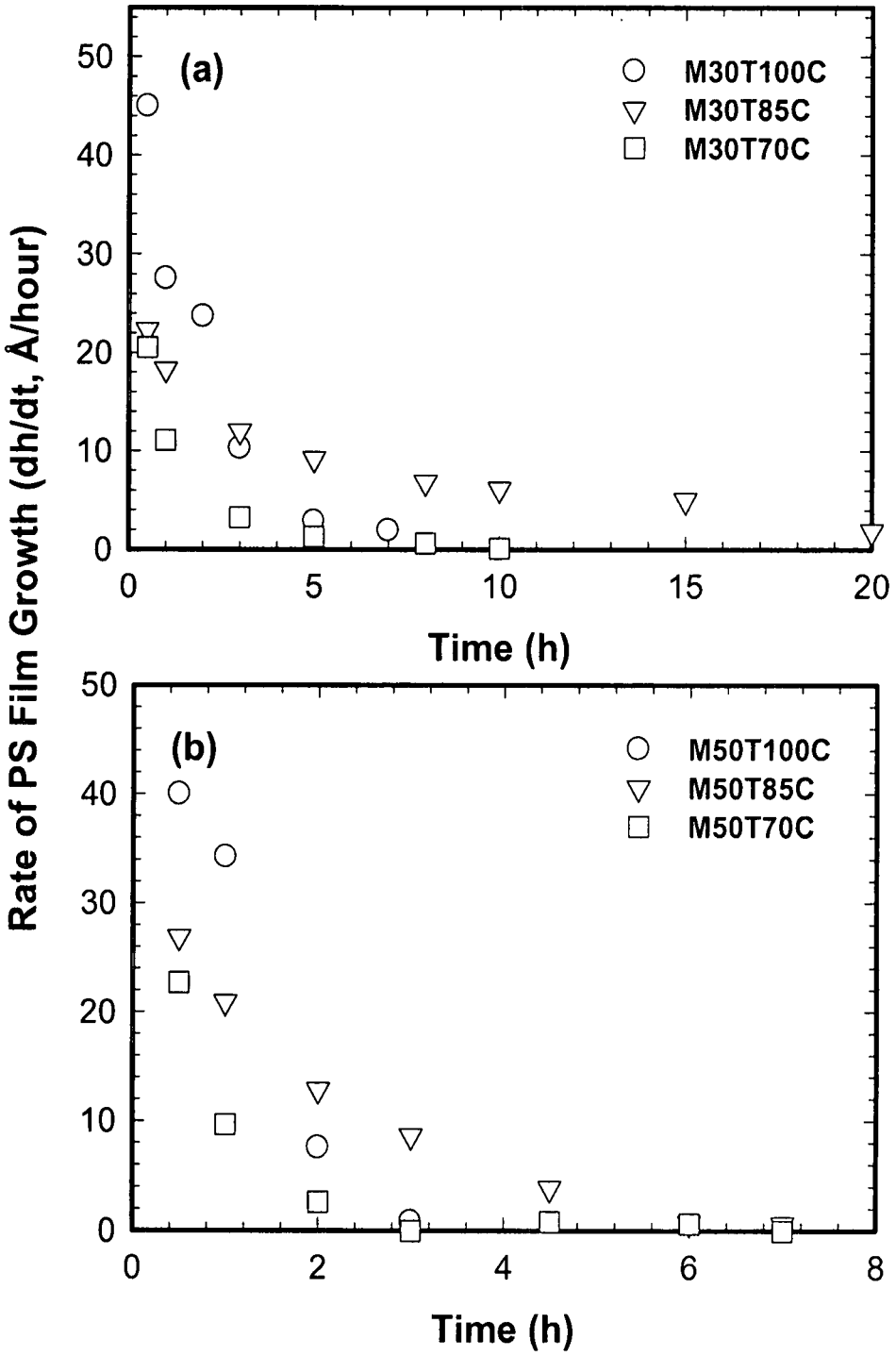
FIG. 11 is a plot showing polystyrene film growth rate (i.e, rate of change of polymer film thickness) versus reaction time for APPIGP at T=70° C., 85° C., and 100° C.: (a) M30, and (b) M50 (surface initiation at treatment time=10 s, RF power=40 W, and RH=50% at 22° C.) according to one embodiment of the invention.

Thermal initiation of polymer chains in Regime III at 100° C. was apparent given the increase in solution viscosity within a short reaction interval as well as heterogeneous polymer grafting, which was verified by a substantial increase of ±10% standard deviation in layer thickness and the presence of visible polymer aggregates on the surface (observed by optical microscope at 10× resolution). The rate of polymer chain growth with reaction time (FIG. 11) further illustrates the effect of reaction temperature on surface chain propagation and chain termination. Graft polymerization for M30 in Regime III resulted in more than a 100% increase in the rate of initial surface chain growth (reaction time<0.5 h) with respect to grafting in Regime I and II (FIG. 11*a*). However, over a longer reaction period (reaction time~8 h), the rate of surface chain growth for Regime II was greater than for Regime I and III, with an initial growth rate of 22.6 Å/hr for grafting in Regime II.

Increasing the initial monomer concentration led to a reduction not only in grafted polymer layer thickness but also in the control of polymer layer growth. Likewise, the initial rate of chain growth (t=0.5 h) for M50 surface grafting increased by more than 10%, 20%, and 24% for Regime I, II, and III, respectively (FIG. 11*b*). Also, an observed decrease in the reaction time interval before the onset of chain termination, with respect to M30 surface grafting, was noted for each reaction regime. Thus, for Regime I, II, and III, a 1:1 volume ratio of monomer to solvent led to both reduced control of layer growth and total layer thickness.

Figure 12:
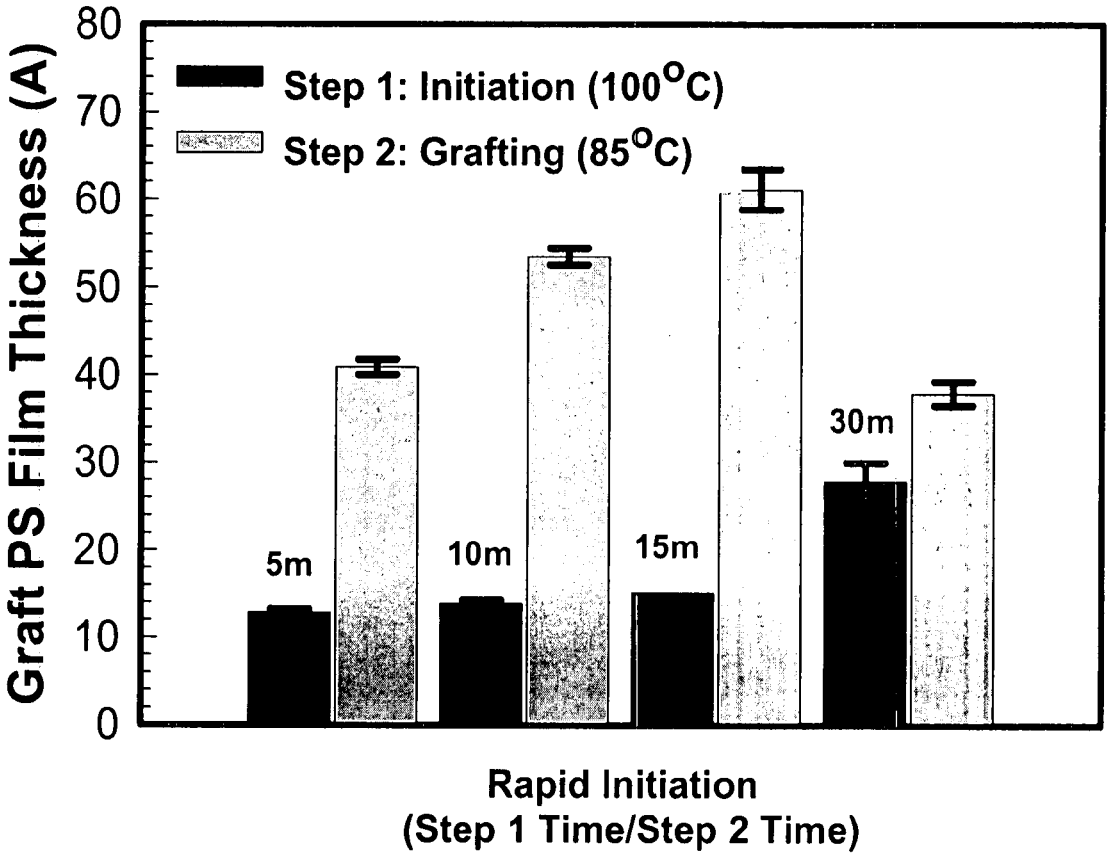
FIG. 12 is a plot of graft polystyrene film thickness for rapid initiation at M30 with a step 1 time interval varied between t=5-30 min. and a step 2 total reaction time of 3 hours (step 1=100° C., step 2=85° C.) according to one embodiment of the invention.
Figure 13:
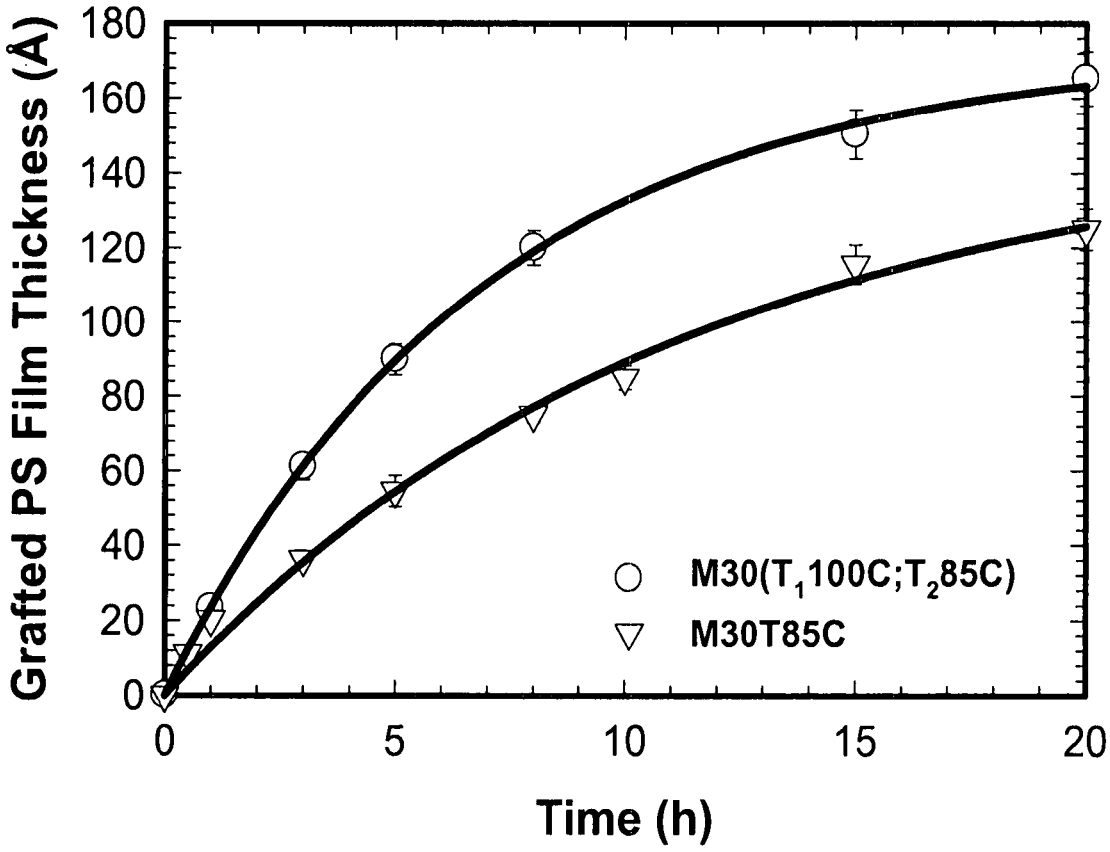
FIG. 13 is a plot of graft polystyrene film growth for (a) rapid initiation APPIGP (step 1=15 min) and (b) APPIGP at M30 and T=85° C. (surface initiation at treatment time=10 s, RF power=40 W, and RH=50% at 22° C.) according to one embodiment of the invention.

In another embodiment of the invention, the surface density of grafted polymers can be increased by combining high temperature initiation, to achieve a high surface density of grafted chains, with low temperature surface polymerization, to reduce polymer grafting and early chain termination. In this manner, a graft polymerization approach described as Rapid Initiation (RI) was used, by which plasma-treated silicon substrates were graft polymerized with 30% styrene in chlorobenzene for a shaft specified time interval at 100° C. (step 1) and then transferred to a separate heating bath at 85° C. (step 2) for the remainder of the reaction time interval. The RI-grafted polymer film growth demonstrated a unique dependence on the step 1 time interval ($t_{s1}$), measured by the layer thickness observed after the step 2 time interval ($t_{s2}$) (FIG. 12). An increase in $t_{s2}$ layer thickness of 38% was observed when $t_{s1}$ was increased from 5-15 min, as expected by the rate of polymerization and fractional coverage of surface initiation sites achieved for a longer exposure to a high reaction temperature. The maximum $t_{s1}$ polymer layer thickness was observed at 15 min, and a 30% decrease in $t_{s2}$ layer thickness was observed when $t_{s1}$ was increased to 30 minutes. The RI-grafted polymer film growth at $t_{s1}$=15 min exhibited similar polymer layer growth behavior in comparison to graft polymerization of 30% (v/v) styrene in chlorobenzene at 85° C., with quasi-linear layer growth over a period of 20 hours. Also, the polymer film thickness after an interval of 20 h increased by 25% (FIG. 13), as expected by the increase in the initial rate of surface grafting.

Figure 14:
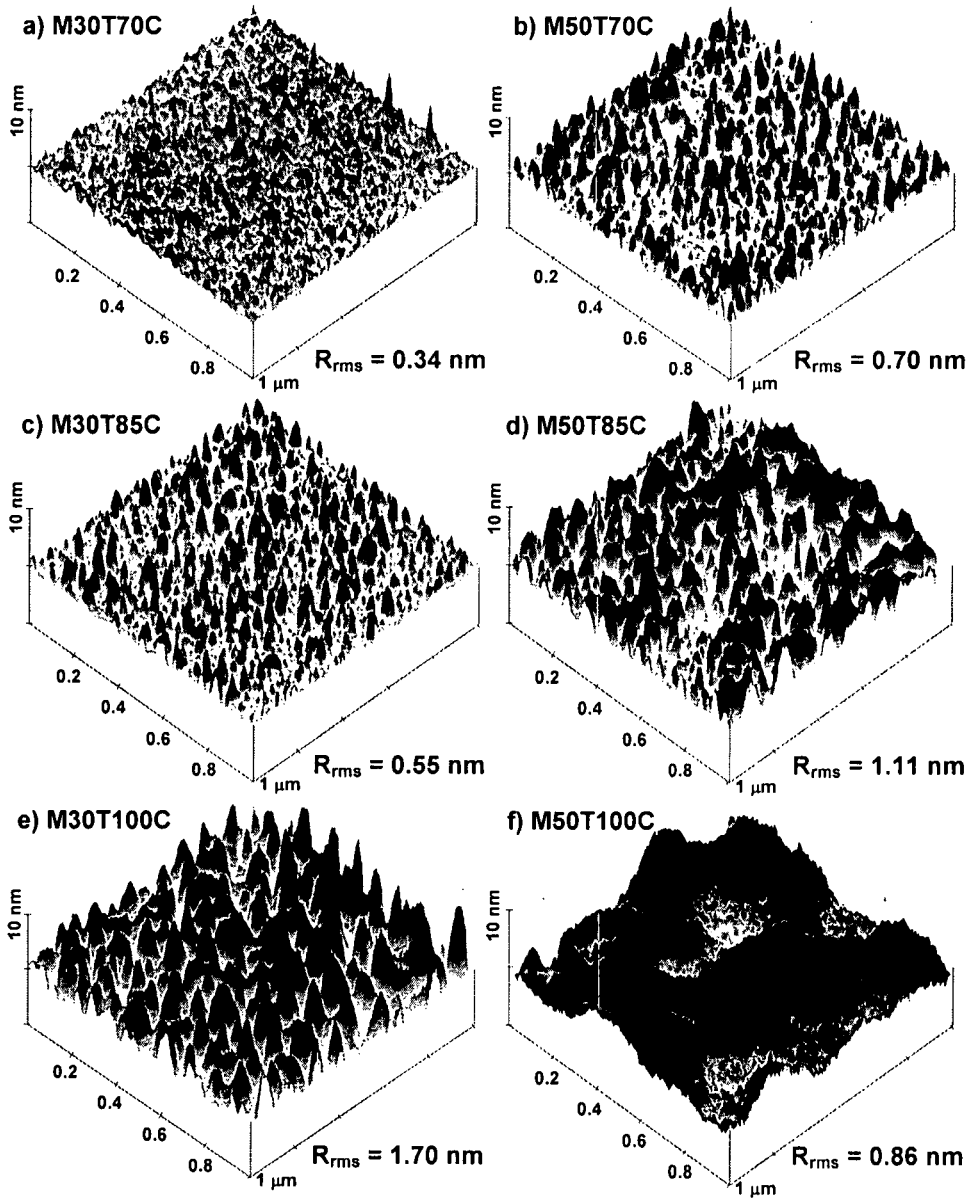
FIG. 14 is a set of tapping mode AFM 3-D surface renderings (1×1 $\mu m^2$) of APPIGP for polystyrene grafted silicon at M30: (a) T=70° C., (b) T=85° C., (c) T=100° C., and at M50: (d) T=70° C., (e) T 85° C., (f) T=100° C., according to one embodiment of the invention.

Atomic Force Microscopy (AFM) was used to image and compare the nanoscale features of the polystyrene layers that were graft polymerized in Regime I, II and III (FIG. 14). Tapping mode AFM of polymer surface features in air allowed for an analysis of the surface feature density, feature height and diameter (i.e., chain length) and the spatial distribution of features in a 1×1 μm area. The increase in initial monomer concentration from M30 to M50 in Regime I and Regime II demonstrated both an increase in surface feature density and the average feature size. M50 grafted surfaces in Regime I resulted in a uniformly dispersed, dimpled feature morphology with lateral feature size in the range of 30-40 nm and more than 100% increase in the RMS surface roughness ($R_{rms}$, eq 1) compared to M30 surface grafting in Regime I. Similarly, comparison of M30 and M50 grafted surfaces in Regime II evidenced a similar increase in $R_{rms}$ from 0.55 to 1.11 nm with average feature sizes in the range of 15-25 to 50-60 nm, respectively. However, it is important to note that, when the monomer concentration was increased to M50 in Regime II, the presence of heterogeneously dispersed, large globular grafted polymer features commingled with smaller polymer surface features was observed by AFM (FIG. 14*d*). The seemingly random and asymmetrical arrangement of surface features is attributed to polymer grafting of chains formed in solution, as a result of high monomer concentration initiated by fragmented initiator species from the surface. The AFM studies for the M50 surfaces confirm previous observations in Regime II of a decrease in the apparent rate coefficient and less controlled layer growth, with termination occurring at shorter time intervals relative to the M30 surfaces. Polystyrene grafted M30 surfaces in Regime III resulted in more than a 3 fold increase in $R_{rms}$ with respect to layers grafted in Regime II (FIG. 14*c*), and were composed of large surface features with lateral feature dimensions of 70-90 nm. However, for M50 surfaces grafted in Regime III, plasma surface initiation combined with thermal solution initiation at elevated monomer concentration resulted in the formation of heterogeneous layers composed of continuous peaks and valleys, presumably a result of chain grafting from solution. The poor quality of the grafted layers, with limited control of grafted polymer layer growth, suggests that these grafted layers would not be suitable for applications that required a high level of surface uniformity.

Figure 15:
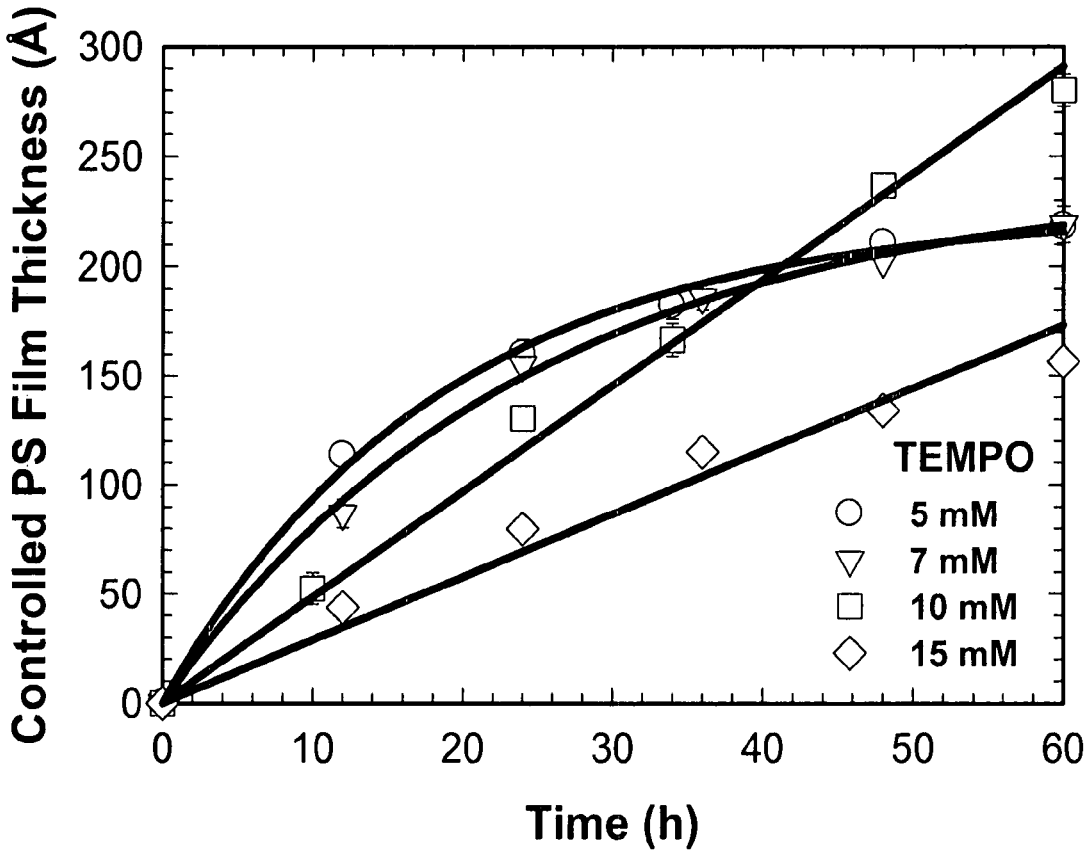
FIG. 15 is a plot showing experimental polystyrene film growth by nitroxide-mediated APPIGP at M50 and [TEMPO]=5, 7, 10, and 15 mM (surface initiation at treatment time 10 s, RF power=40 W, and RH=50% at 22° C.) according to one embodiment of the invention.

Plasma-Induced NMGP Layer Growth. In Ex. 8, controlled nitroxide-mediated graft polymerization (NMGP) studies were conducted using 2,2,6,6-tetramethyl-1-piperidinyloxy radical (TEMPO) to reversibly cap polymer chains growing both in solution and from the surface, thereby preventing uncontrolled polymerization. Controlled radical polymerization, noted by the linear increase in grafted layer thickness with time, was achieved by graft polymerization of M50 surfaces at 120° C. in the presence of TEMPO at [T]=10 mM to yield a polystyrene brush layer thickness of 283.4 Å. The kinetic growth curves of NMGP with addition of TEMPO ([T]=5-15 mM) are shown in FIG. 15. Increased control of surface grafting was achieved by increasing the concentration of TEMPO from 5 to 10 mM, as noted by a 35% increase in total polymer layer growth, as shown in Table 5.

TABLE 5

| [TEMPO] (mM) | Polymer Film Thickness (Å)[a] | Water Contact Angle (°) |
|---|---|---|
| 5 | 210.4 ± 1.2 | 90.0 |
| 7 | 219.1 ± 2.7 | 90.0 |
| 10 | 283.4 ± 2.2 | 90.0 |
| 15 | 1899 ± 1.9 | 90.0 |

[a]Total polymer film thickness measured by ellipsometry at final data point.

Further addition of TEMPO did not alter the behavior of the linear layer growth but significantly reduced the total layer growth. The decrease in layer growth with increased TEMPO is presumably a direct result of the equilibrium shift towards the dormant phase, thus increasing the frequency of chain capping and reducing the growth of radical polymer chains in solution.

The effect of reaction temperature for NMGP was illustrated by a non-linear dependence over a temperature range of T=100-130° C., as shown in Table 6.

TABLE 6

| Temperature (° C.) | Polymer Film Thickness (Å)[a] |
|---|---|
| 100 | 38.1 ± 6.6 |
| 110 | 53.4 ± 6.7 |
| 120 | 283.4 ± 2.2 |
| 130 | 125.2 ± 2.5 |

[a]Total polymer film thickness measured by ellipsometry at final data point.

Figure 16:
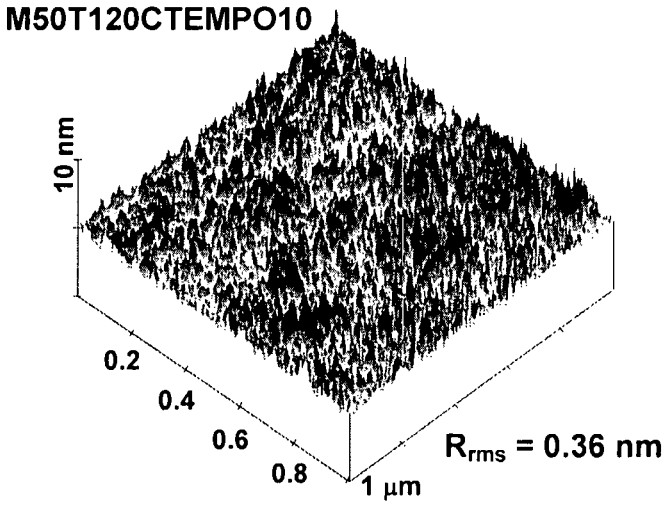
FIG. 16 is a tapping mode AFM 3-D surface rendering (1×1 $\mu m^2$) of nitroxide-mediated APPIGP for polystyrene grafted silicon at M50, T=120° C., and [TEMPO]=10 mM according to one embodiment of the invention.
Figure 17:
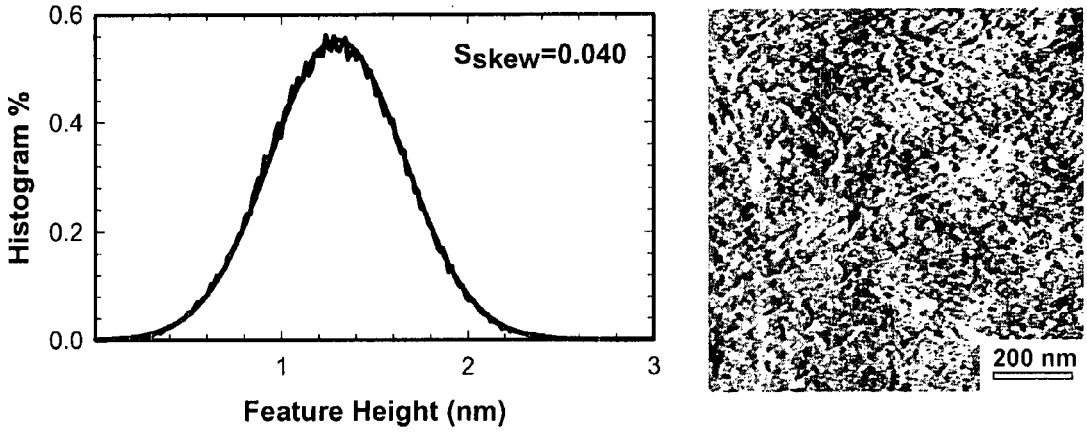
FIG. 17 is a height histogram (with fitted Gaussian distributions) and AFM image (Right) of nitroxide-mediated APPIGP for polystyrene grafted silicon at M50, T=120° C., and [TEMPO]=10 mM according to one embodiment of the invention.

Atomic Force Microscopy was used to image the topology of the NMGP polymer grafted layers (FIG. 16) and to elucidate the contribution of surface feature size in the height histogram (FIG. 17). The AFM images of the NMGP polymer layer were characterized by a spatially homogeneous, highly dense grafted polymer phase with features of uniform surface height represented by an $R_{rms}$ of 0.36 nm, nearly 80% less than for the M30 grafted surface in Regime II ($R_{rms}$=1.70 nm). In fact, the uniformity of surface feature height for the controlled polystyrene grafted layer remarkably resembled that of the native silicon surface ($R_{rms}$ 0.20≈nm). The height histogram data illustrated in FIG. 14 suggested a highly uniform polymer feature height distribution, as confirmed by the skewness of the height distribution that approached zero with a characteristic width of the Gaussian distribution of ω=1.3 nm. In comparison to other controlled "living" free radical graft polymerization methods, an RMS surface roughness of 0.7 nm was reported for "living" surface initiated anionic graft polymerization of polystyrene to silicon. Also, the surface topology anionic graft polymerized polystyrene, as illustrated by AFM imaging, suggested a dendritic structure with "hole" defects ranging in size from 0.2-0.3 μm in diameter and 11-14 nm in depth, uniformly dispersed throughout the layer. The rationale provided by the author for the defect morphology was due to the low grafting density on the silicon surface. Therefore, it may be concluded that the current method for NMGP on silicon, in comparison to other FRGP or "living" controlled polymerization methods, not only achieved a high fractional surface density of grafted polymers due to plasma surface initiation, but also demonstrated controlled polymerization in the presence of TEMPO with 1) linear layer growth with respect to time, 2) a decreased RMS surface roughness and 3) a decreased height distribution skewness.

In the absence of the TEMPO control agent, kinetic growth of polymer layers by plasma-induced FRGP demonstrated a maximum layer thickness for surface grafting at 30 vol. % monomer concentration at 85° C. Increasing both the reaction temperature (T=100° C.) and monomer concentration (50 vol. %) led to an increased initial growth rate but a reduced polymer layer thickness, due to uncontrolled thermal initiation and polymer grafting from solution. AFM images of grafted polystyrene layers confirmed the kinetic growth data with highly uniform surface grafting at low monomer concentration and reaction temperature and heterogeneous, globular surface feature formation at high monomer concentration and reaction temperature. Surface grafting by controlled NMGP exhibited linear kinetic growth with respect to time and surfaces imaged by AFM were characterized by a low surface roughness with a uniform distribution of surface feature heights.

Figure 18:
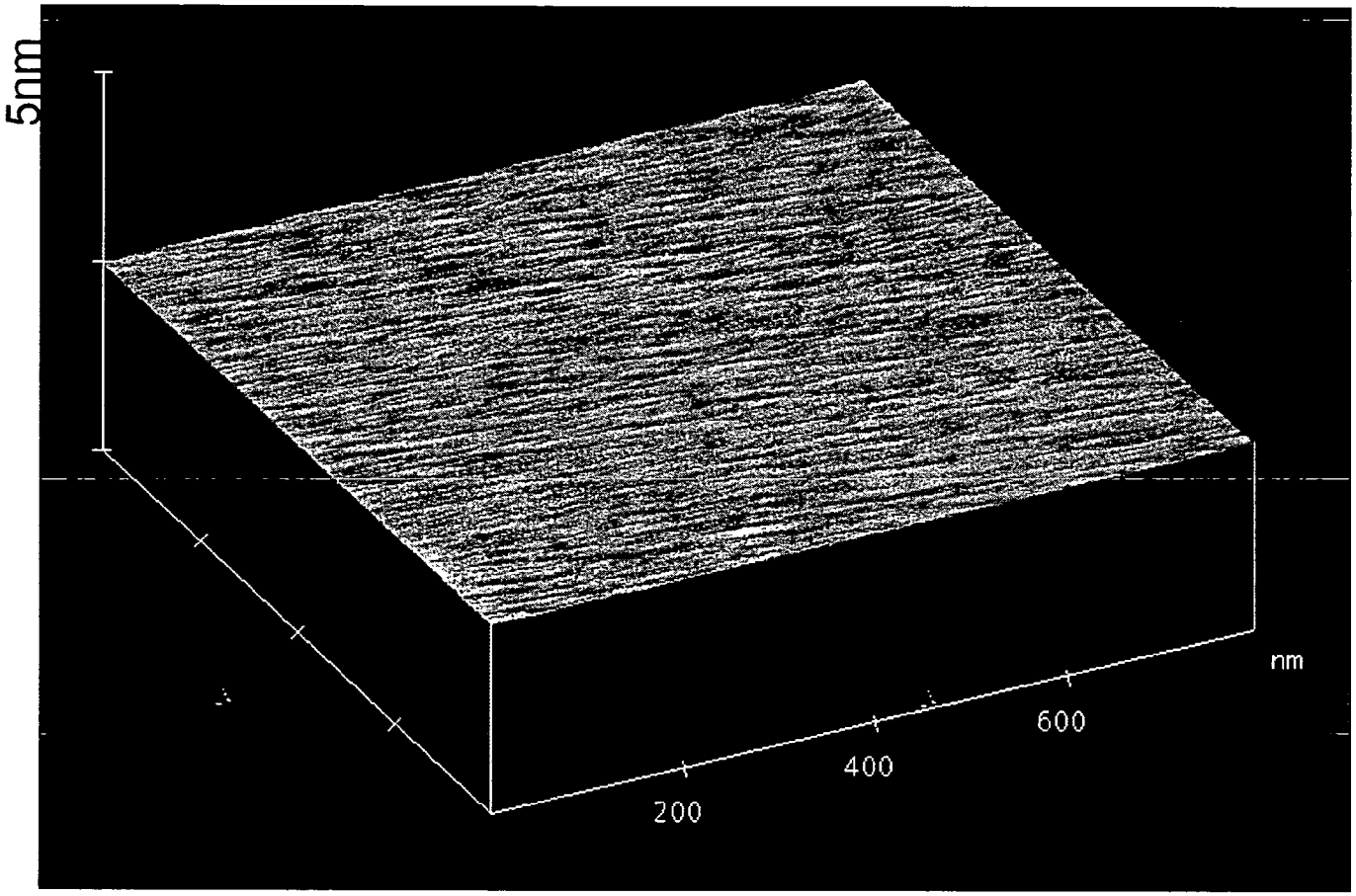
FIG. 18 is a tapping mode AFM 3-D surface rendering of a silicon surface prior to AP plasma treatment.
Figure 19:
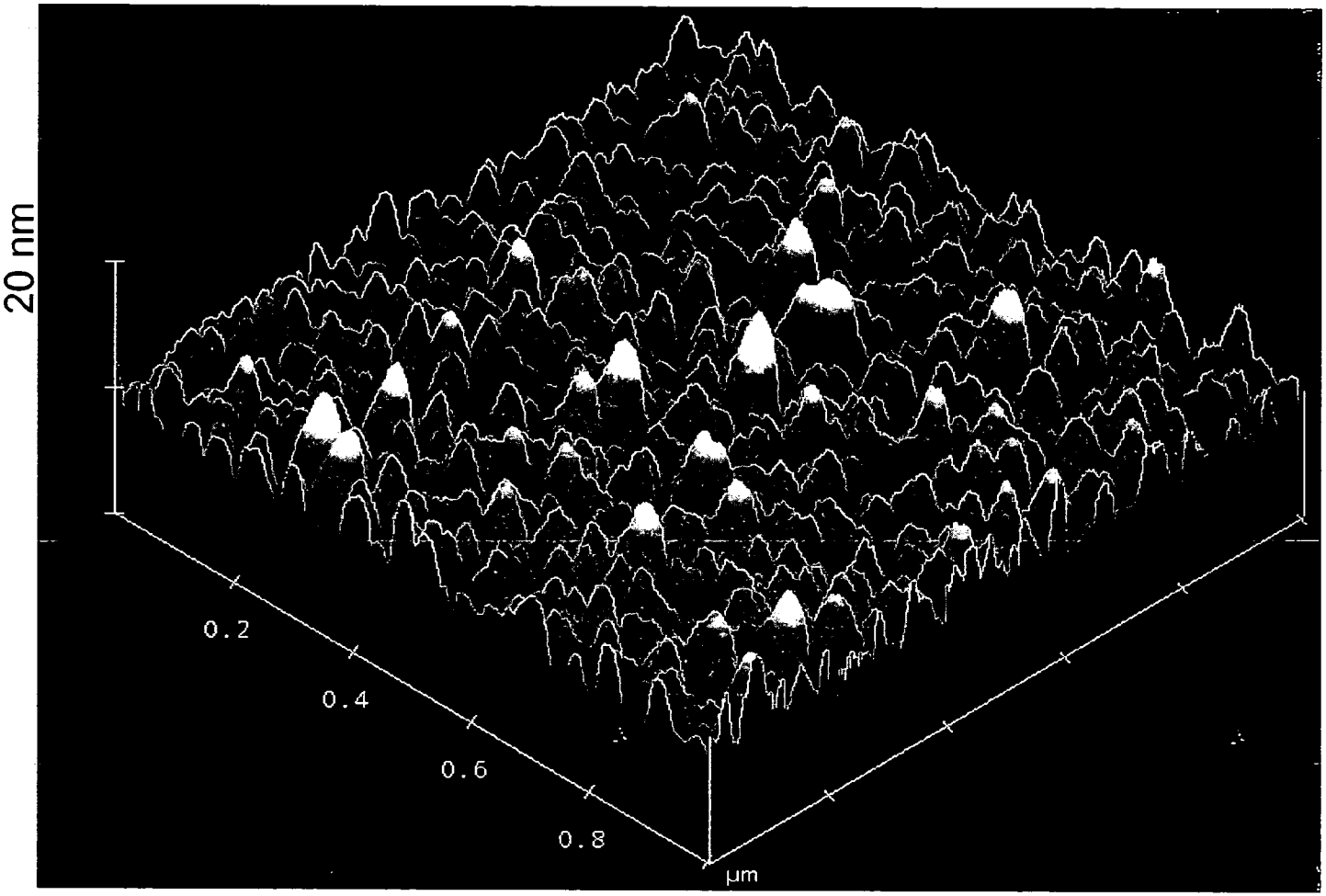
FIG. 19 is a tapping mode AFM 3-D surface rendering of a silylated silicon surface prior to AP plasma treatment.
Figure 20:
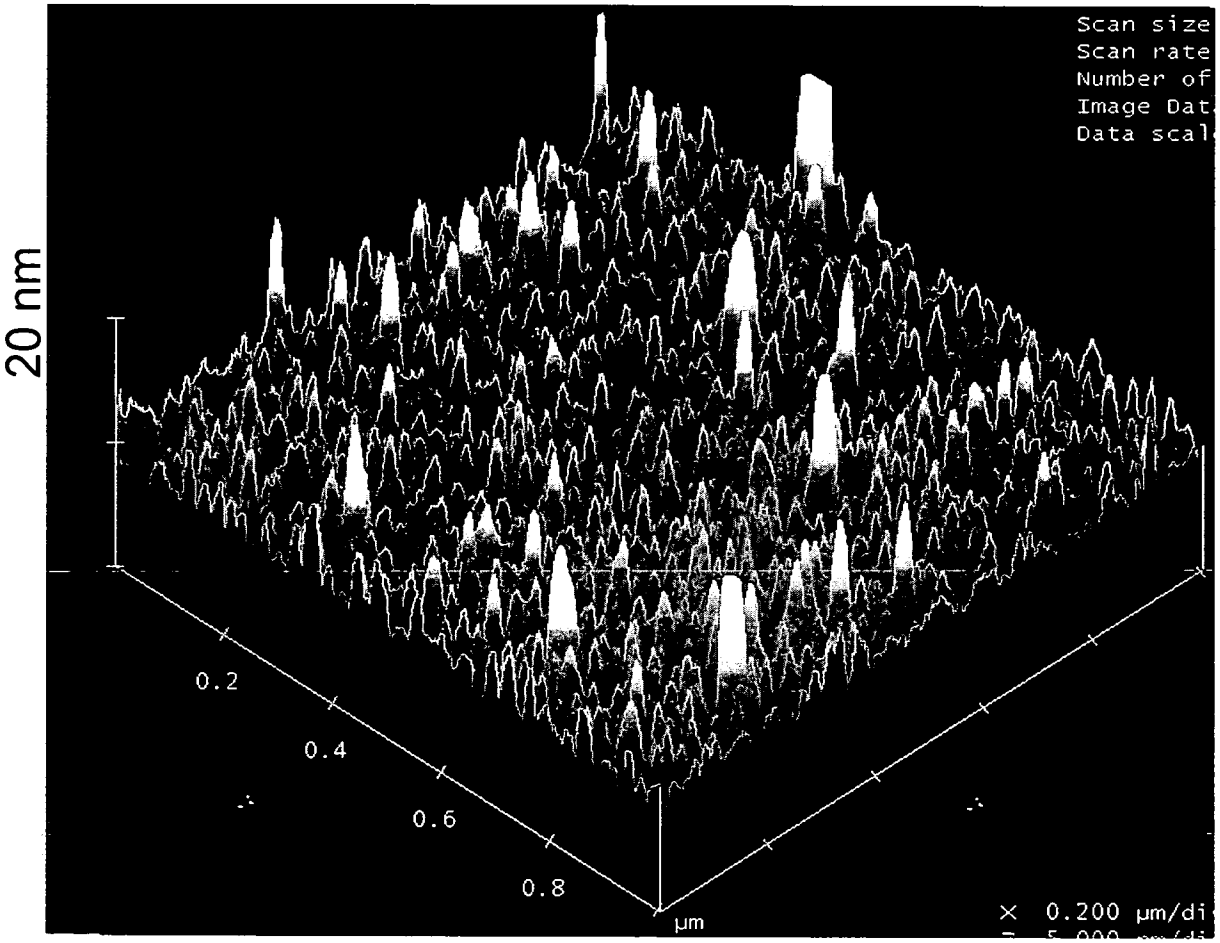
FIG. 20 is a tapping mode AFM 3-D surface rendering of an APPIG polymerization-modified silicon surface according to one embodiment of the invention (Ex. 2)(hydrogen plasma, 10 s, 40 W; 30% (v/v) 1-vinyl-2-pyrrolidone monomer in n-methyl-2-pyrrolidone; T=80° C.)
Figure 21:
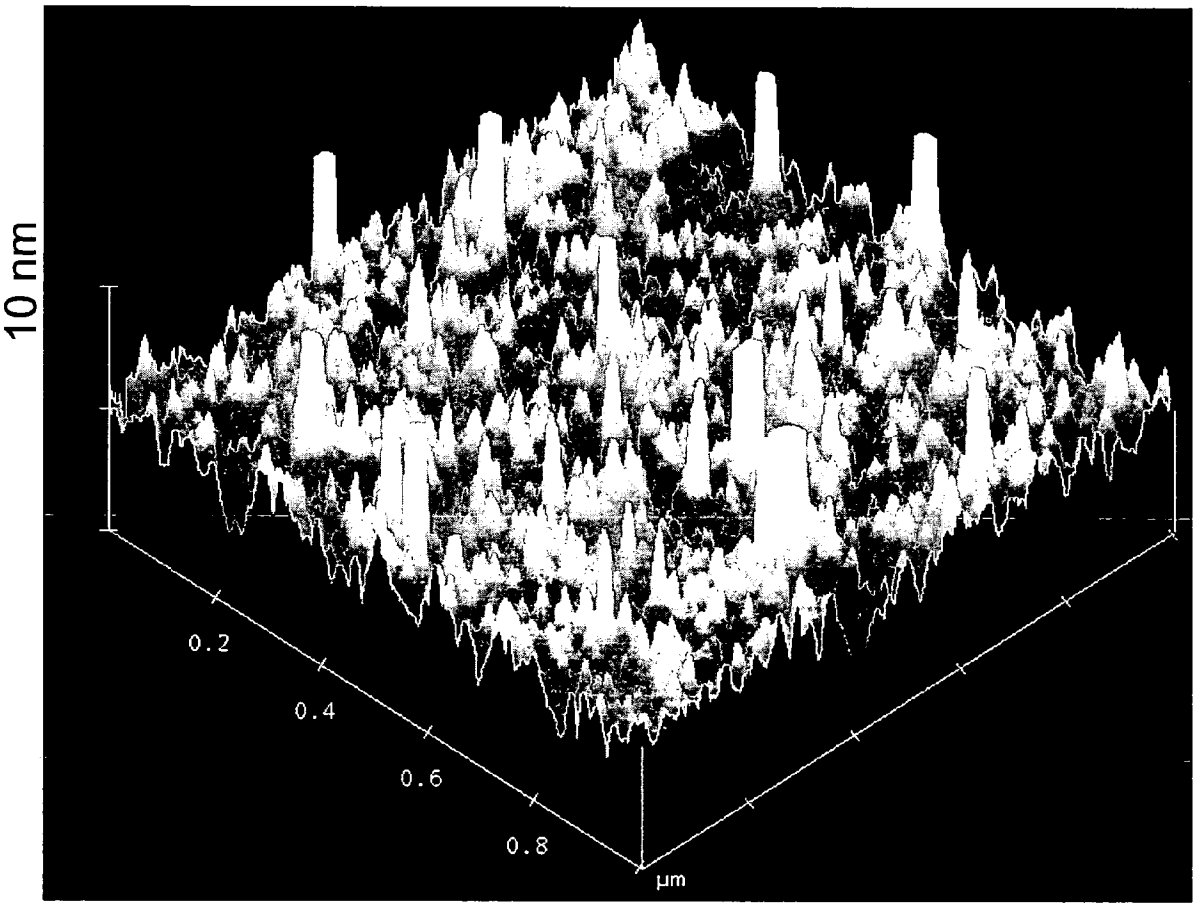
FIG. 21 is a tapping mode AFM 3-D surface rendering of an APPIG polymerization-modified silicon surface according to one embodiment of the invention (Ex. 2) (hydrogen plasma, 10 s, 40 W; 30% (v/v) 1-vinyl-2-pyrrolidone monomer in n-methyl-2-pyrrolidone; T=90° C.)
Figure 22:
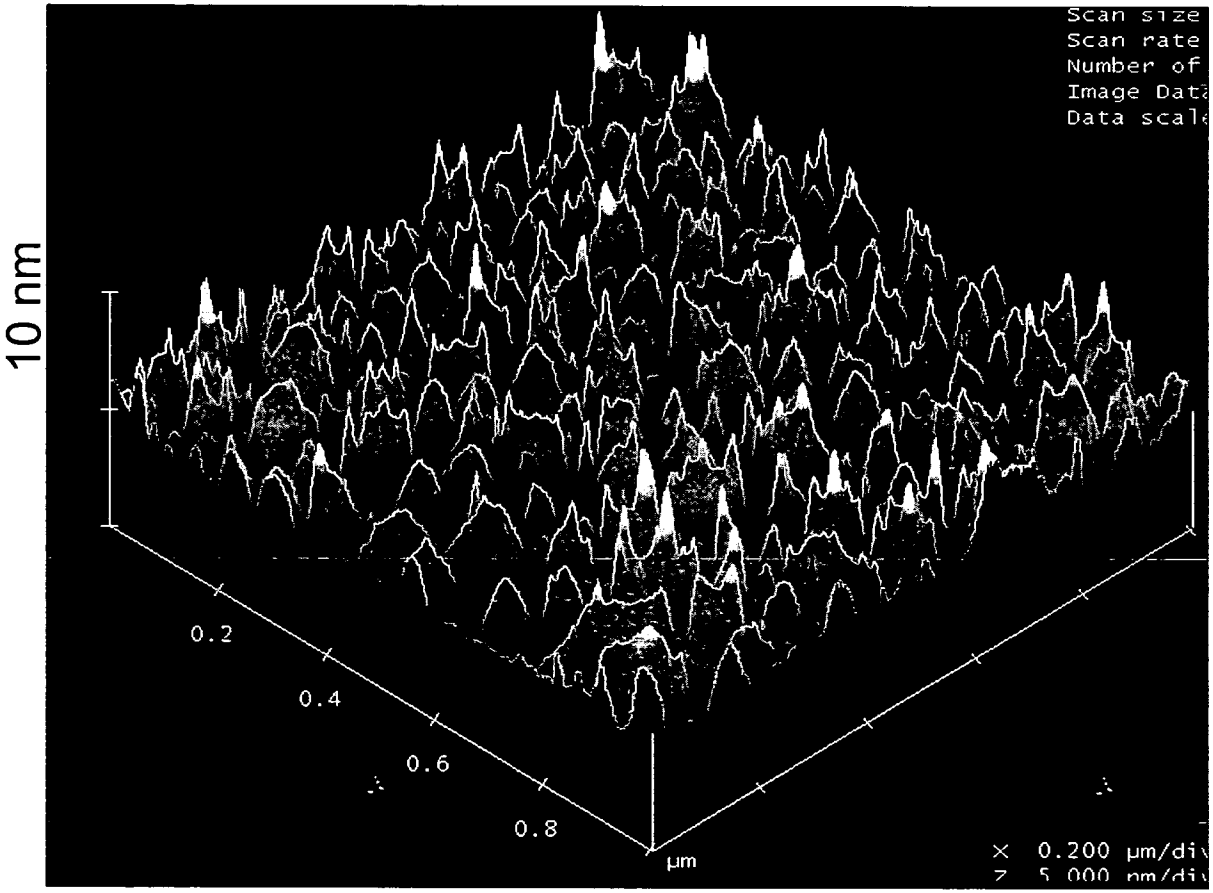
FIG. 22 is a tapping mode AFM 3-D surface rendering of an APPIG polymerization-modified silicon surface according to one embodiment of the invention (Ex. 3) (hydrogen plasma, 10 s, 40 W; 30% (v/v) 1-vinyl-2-pyrrolidone monomer in a 60% (v/v) aqueous mixture of n-methyl-2-pyrrolidone; T=80° C.)
Figure 23:
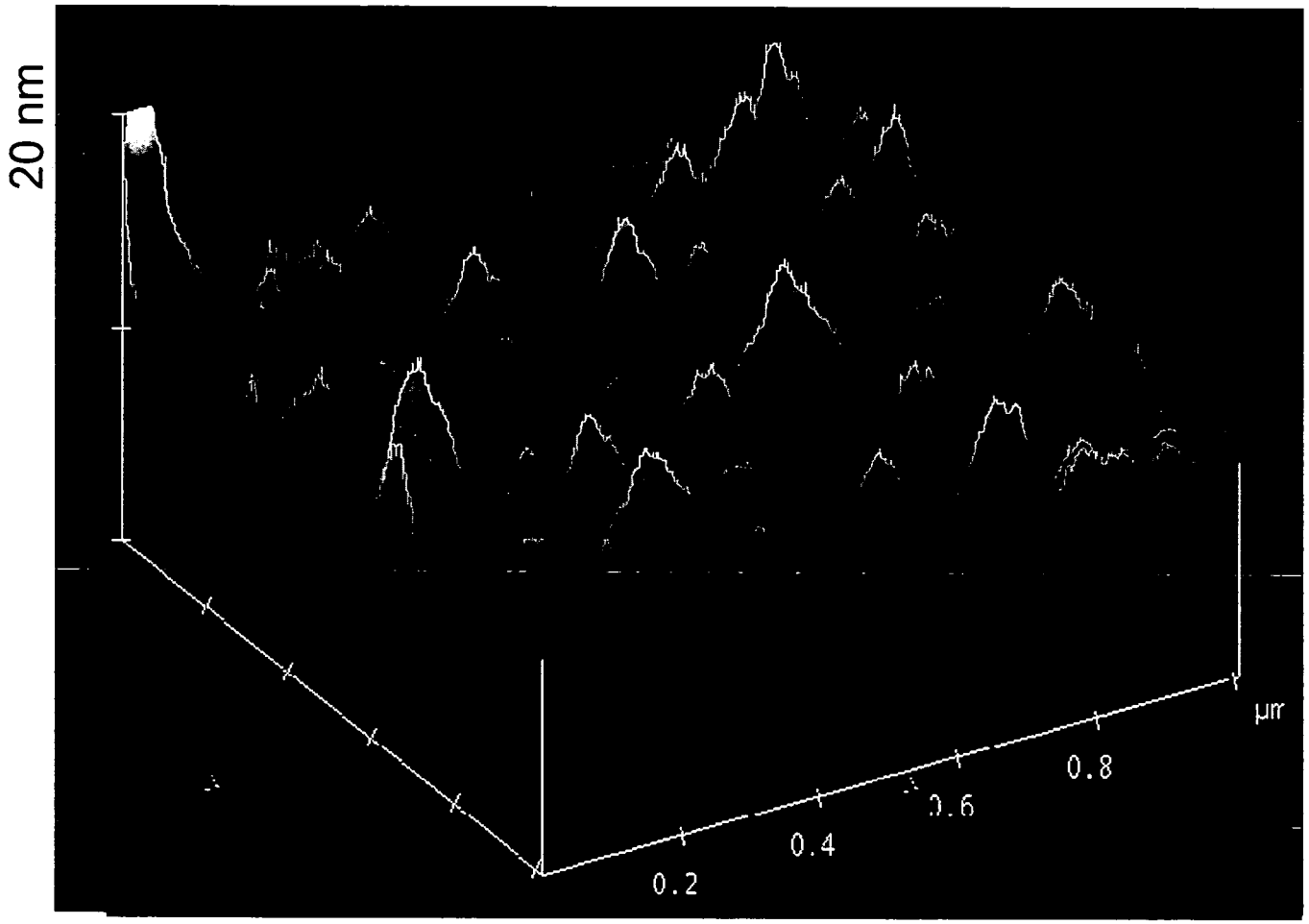
FIG. 23 is a tapping mode AFM 3-D surface rendering of an APPIG polymerization-modified silylated silicon surface according to one embodiment of the invention (Ex. 4)(hydrogen plasma, 10 s, 40 W; 30% (v/v) 1-vinyl-2-pyrrolidone monomer in DI water; T=80° C.)
Figure 24:
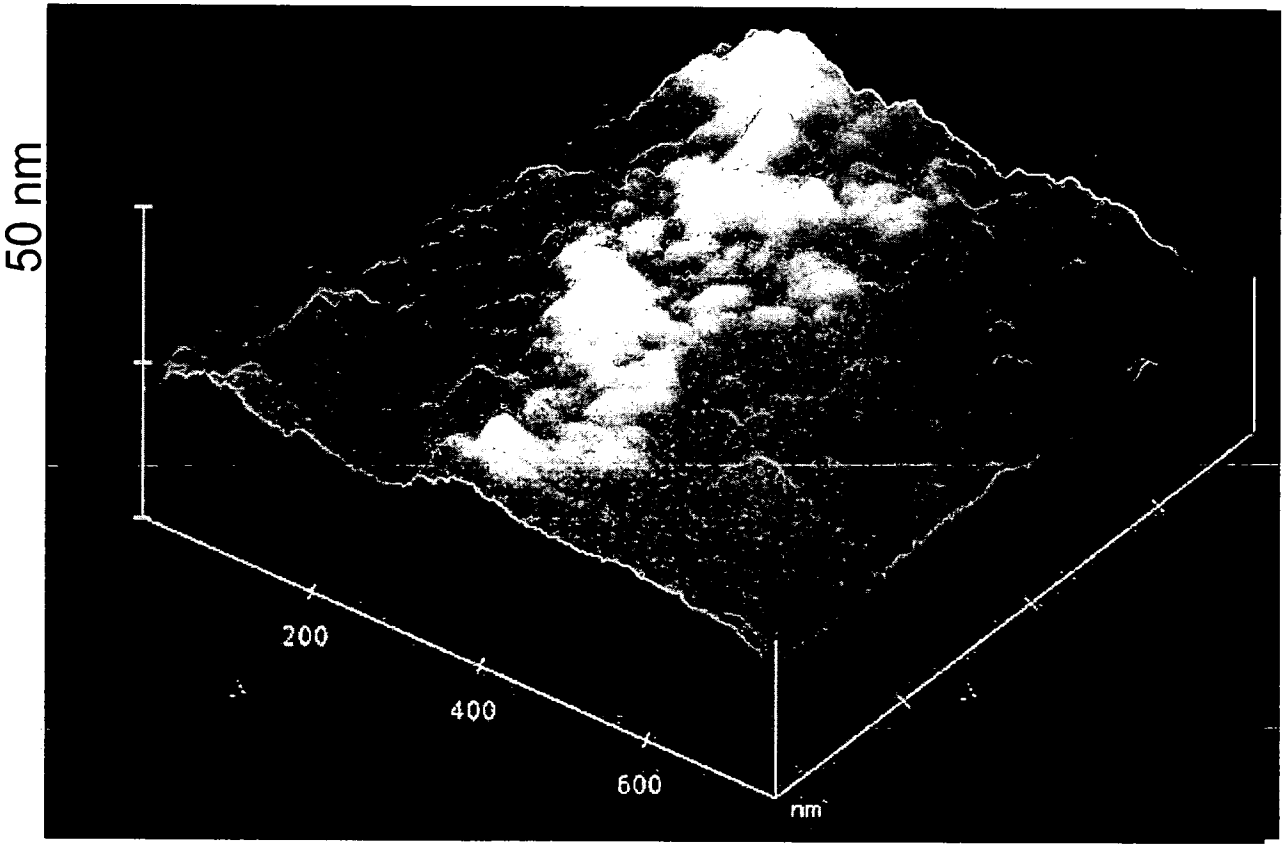
FIG. 24 is a tapping mode AFM 3-D surface rendering of an APPIG polymerization-modified polysulfone surface according to one embodiment of the invention (Ex. 6) (hydrogen plasma, 10 s, 40 W; 30% (v/v) 1-vinyl-2-pyrrolidone monomer in DI water; T=70° C.)
Figure 25:
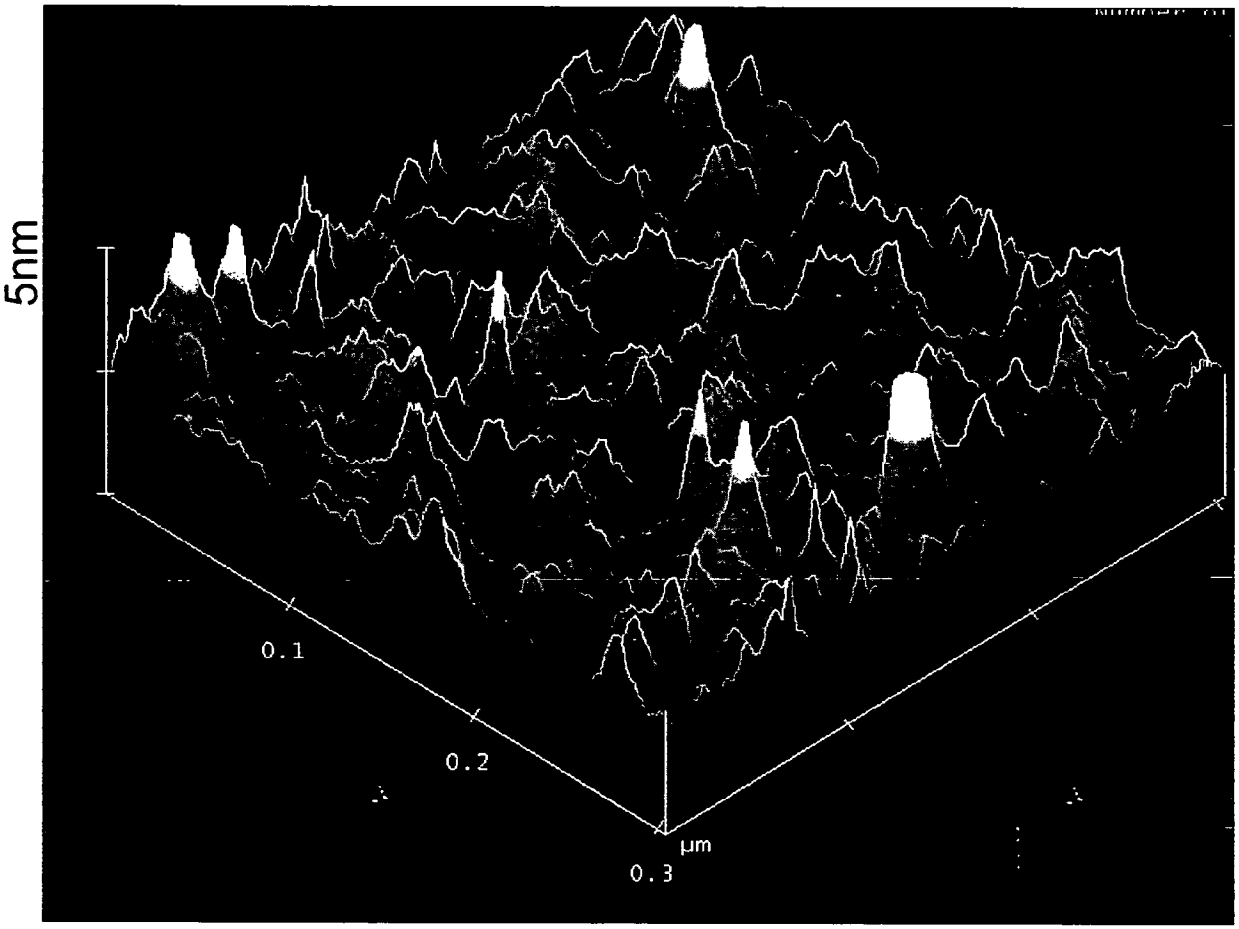
FIG. 25 is a tapping mode AFM 3-D surface rendering of an APPIG polymerization-modified silicon surface according to one embodiment of the invention (Ex. 10) (hydrogen plasma, 10 s, 40 W; 30% (v/v) vinyl acetate monomer in ethyl acetate; T=70° C.).

Tapping mode 3-D surface renderings of examples 2-4, 6, and 10 of the invention are provided in FIGS. 20-25. For comparison, FIGS. 18 and 19 are 3-D surface renderings of silicon and silylated silicon, respectively, prior to plasma treatment.

The present invention has been described with reference to exemplary embodiments and aspects, but is not limited thereto. Persons skilled in the art will appreciate that other modifications and applications can be made without meaningfully departing from the invention. Accordingly, the description should be read consistent with and as support for the following claims, which are to have their fullest and fairest scope, both literally and under the doctrine of equivalents.

Throughout the text and the claims, use of the term "about" in relation to a range of values is intended to modify both the high and low values recited, and reflects the penumbra of variation associated with measurement, significant figures, and interchangeability, as understood by a person having ordinary skill in the art to which this invention pertains.

This application is based on and claims priority of U.S. provisional patent application No. 60/857,874, filed Nov. 10, 2006, the entire contents of which are incorporated by reference herein.

What is claimed is:

1. A method of modifying a substrate surface by plasma-induced graft polymerization, comprising:

treating an inorganic substrate with (a) an atmospheric pressure (AP) plasma and (b) an ethylenically unsaturated monomer or monomer solution, further comprising cleaning the inorganic substrate and conditioning the inorganic substrate for a desired length of time prior to treating the inorganic substrate with the AP plasma, wherein conditioning the inorganic substrate results in formation of a layer of adsorbed water on the inorganic substrate, wherein treating the inorganic substrate with the AP plasma comprises flowing the AP plasma towards the inorganic substrate, on which there is the layer of adsorbed water, to form active sites on the inorganic substrate, wherein flowing the AP plasma is carried out using a plasma jet, and wherein treating the inorganic substrate with the ethylenically unsaturated monomer or monomer solution forms polymer chains covalently and terminally bound to the inorganic substrate, and a spacing of the polymer chains on the inorganic substrate is in the range of 5 nm to 50 nm.

2. A method as recited in claim 1, wherein the inorganic substrate comprises an elemental material selected from the group consisting of silicon, aluminum, hafnium, zirconium, titanium, iron and gold.

3. A method as recited in claim 2, wherein the inorganic substrate comprises a silicon wafer.

4. A method as recited in claim 1, wherein the inorganic substrate comprises an inorganic oxide.

5. A method as recited in claim 4, wherein the inorganic oxide is selected from the group consisting of silica, alumina, hafnia, zirconia, and titania.

6. A method as recited in claim 1, wherein the inorganic substrate comprises a metallic or ceramic material capable of supporting formation of surface oxides, hydroxides, peroxides, or other functional groups capable of initiating polymerization of an unsaturated monomer.

7. A method as recited in claim 1, wherein the spacing of the polymer chains is in the range of 5 nm to 20 nm.

8. A method as recited in claim 1, wherein the spacing of the polymer chains is in the range of 5 nm to 10 nm.

9. A method as recited in claim 1, wherein a thickness of the polymer chains on the inorganic substrate is in the range of 60 Å to 160 Å.

10. A method as recited in claim 1, wherein a thickness of the polymer chains on the inorganic substrate is in the range of 120 Å to 160 Å.

11. A method as recited in claim 1, wherein the AP plasma is formed from a precursor gas selected from the group consisting of hydrogen, oxygen, nitrogen, air, ammonia, argon, helium, carbon dioxide, $H_2O$, methane, ethane, propane, butane, and mixtures thereof.

12. A method as recited in claim 11, wherein the precursor gas is carried by a carrier gas.

13. A method as recited in claim 1, wherein plasma treatment is carried out over about a 5 to 120 second time period and at a RF power of from about 20 to 60 W using a hydrogen plasma.

14. A method as recited in claim 1, wherein plasma treatment is carried out over about a 10 second time period and at a RF power of about 40 W.

15. A method as recited in claim 1, wherein the layer of adsorbed water is substantially a molecular monolayer.

16. A method as recited in claim 1, wherein the ethylenically unsaturated monomer comprises a vinyl or divinyl monomer.

17. A method as recited in claim 1, wherein the ethylenically unsaturated monomer comprises an acid vinyl monomer, acrylic or methacrylic ester, polar vinyl monomer, or non-polar vinyl monomer.

18. A method as recited in claim 17, wherein the acid vinyl monomer comprises acrylic acid or methacrylic acid.

19. A method as recited in claim 17, wherein the ethylenically unsaturated monomer comprises 1-vinyl-2-pyrrolidone.

20. A method as recited in claim 17, wherein the ethylenically unsaturated monomer comprises styrene.

* * * * *